US009052154B1

(12) United States Patent
Prior

(10) Patent No.: US 9,052,154 B1
(45) Date of Patent: Jun. 9, 2015

(54) PROJECTILE LAUNCHER

(71) Applicant: Michael W. Prior, Silver Spring, MD (US)

(72) Inventor: Michael W. Prior, Silver Spring, MD (US)

( * ) Notice: Subject to any disclaimer, the term of this patent is extended or adjusted under 35 U.S.C. 154(b) by 0 days.

(21) Appl. No.: 14/313,764

(22) Filed: Jun. 24, 2014

Related U.S. Application Data

(62) Division of application No. 14/165,544, filed on Jan. 27, 2014, now Pat. No. 8,863,732.

(51) Int. Cl.
*F41B 5/12* (2006.01)

(52) U.S. Cl.
CPC ..... *F41B 5/12* (2013.01)

(58) Field of Classification Search
CPC ..... F41B 5/123; F41B 5/12; F41B 5/105; F41B 5/10; F41B 5/0052; F41B 5/0094; F41B 5/126
See application file for complete search history.

(56) References Cited

U.S. PATENT DOCUMENTS

| | | | | |
|---|---|---|---|---|
| 3,509,863 | A | 5/1970 | Barker | |
| 3,968,783 | A | 7/1976 | Pfotenhauer | |
| 4,169,456 | A | 10/1979 | Van House | |
| 5,355,866 | A | 10/1994 | Hunter | |
| 6,273,078 | B1 | 8/2001 | Schwesinger | |
| 7,743,760 | B2 | 6/2010 | Woodland | |
| 7,836,871 | B2 | 11/2010 | Kempf | |
| 7,926,474 | B2 | 4/2011 | Berry | |
| 7,997,258 | B2 | 8/2011 | Shepley et al. | |
| 2013/0213372 | A1* | 8/2013 | Biafore et al. | 124/25 |
| 2014/0069400 | A1* | 3/2014 | Nebergall | 124/25 |
| 2014/0261358 | A1* | 9/2014 | Pulkrabek et al. | 124/25.6 |

* cited by examiner

*Primary Examiner* — Melba Bumgarner
*Assistant Examiner* — Amir Klayman
(74) *Attorney, Agent, or Firm* — Richard C Litman

(57) ABSTRACT

The projectile launcher with internal bow includes a riser base, an elongate barrel assembly attached to the riser base, a crank mechanism attached to the back of the barrel assembly, a trigger assembly, and an internal bow assembly mounted to the riser base. The crank assembly includes a rotatable crank for selective reciprocation of a cocking pawl carriage riding inside a rail system in the barrel assembly. A biased cocking pawl in the pawl carriage selectively engages a projectile stirrup carriage riding on top of the rail system to push the stirrup carriage into a cocked position. The internal bow assembly includes reversed and vertically spaced, upper and lower resilient bow arms and respective pulleys and cables interconnecting the bow arms and the stirrup carriage. Cocking of the stirrup carriage flexes the bow arms in preparation for placement and firing of a projectile.

5 Claims, 23 Drawing Sheets

PROJECTILE LAUNCHER

This is a divisional of my prior application Ser. No. 14/165,544, filed Jan. 27, 2014, now U.S. Pat. No. 8,863,732.

BACKGROUND OF THE INVENTION

1. Field of the Invention

The present invention relates to archery weapons, and particularly to a projectile launcher provided with covered, internalized bow elements and corresponding cocking mechanism for increased balance, safe handling, and minimized effort in operation.

2. Description of the Related Art

Crossbows have long been known in the art. The traditional design dates back to the 14th century or earlier, when very high powered crossbows were effective, especially against armored horsemen. A large medieval crossbow of circa 1500 AD might have a draw weight of 1200 lbs. and a range of 450 yards. In modern times, crossbows rarely exceed 200 lbs. draw weight. Modern crossbows now use sighting mechanisms of various sorts, advanced composite materials and metal alloys, wheel/pulley systems, etc., but otherwise are little changed, except in style and construction materials. Draw weights are dramatically lower, which are tailored to target shooting or hunting applications, rather than warfare.

Crossbows normally use rifle-style stocks. Indeed, the modern rifle design originated with the medieval crossbow. Sights may be aperture sights as found on a rifle, pin sights as on a compound longbow, or telescopic sights. A modern 200 lb. draw weight heavyweight crossbow will achieve similar projectile speeds to a 60 lb. peak draw weight compound hand bow, and the bolt and arrow weights are also similar (300-400 grains).

The crossbow, being relatively short compared to recurve bows and the like, requires comparatively more force to bend. Most crossbows must be cocked by using the feet and legs or a mechanical aid for very powerful bows. Because of the large amount of force applied and mechanical energy stored and released, significant safety concerns exist due to the structure of a conventional crossbow.

The bowstring sweeps along the top of the bow, and it is external. The bow limbs extend out to the sides of the crossbow and sweep forward when fired. The bolt travels openly exposed down the rail at high speeds when fired. Consequently, the user must exercise caution when cocking and uncocking, handling a cocked bow (whether loaded or unloaded), and firing to avoid inadvertent bodily contact with high energy and sharpened bow components. For example, the user must always take into account the sweep of the limbs when firing to prevent limb contact with external objects, which can cause significant back force into the stock and ultimately to the user's body (often facial area). The user must avoid putting fingers/hands between the cocked bow and the bowstring.

The traditional crossbow, with its exposed mechanism and bowstring cocking mechanism, is not a compact design, which presents some ease of use concerns when applied to hunting applications as compared to a firearm/gun, and even the typical longbows and the like. The large cross-sectional area created by the bow limbs being mounted transverse to the stock can result in frequent snagging with tree limbs and foliage when being transported in the field. Mitigating the safety concerns described above often results in limited shooting angles when hunting in close proximity to trees due to the need for accommodating a "safe zone" around the bow limbs. The use of external (to the bow) cocking mechanisms that must be attached to the bow each time it is cocked or uncooked and that rely upon the physical strength of the user to perform these actions can often result in cumbersome and strenuous manipulations of the bow and associated equipment in a hunting scenario due to limited space.

The use of the cross-mounted bow and string also introduce potential shooting inaccuracy. Unless the bow is exactly evenly cocked such that the bowstring center point is being held by the trigger mechanism, side forces will be imparted on the bolt during acceleration down the rail, which will adversely affect its flight accuracy. Cocking the bow even 1/16" off center will drastically change the bolt's point of impact.

Accurate aiming with crossbows is also adversely affected by their typical design. The conventional crossbow has an imbalanced weight distribution, which places the center of mass far forward of the weapon, due to the bow limbs and associated mounting placed at the distal end of the rail or table. Thus, the user must compensate and support the weighty forward end with more strength and care during aiming compared to typical firearms, such as rifles or the conventional recurve bow. One attempt to address this issue places the mounting hardware near the rear of the elongate table, and the bow limbs are mounted in reverse orientation from traditional, i.e., the arch of the bow faces the user instead of away from the user. This type of crossbow may provide better balance, but it still experiences the same type of concerns mentioned above, i.e., safety and the need to accommodate the cross-extending bow limbs during use.

Another concern of traditional crossbow designs arises from the results of a completed shot. The sudden dissipation of energy at the end of a shot through various components of the crossbow can cause excessive vibration in the bowstring resulting in noise akin to a plucked guitar string. Since hunting requires a degree of stealth, anything compromising this aspect, such as the noise from a loosed bowstring, is highly undesirable. One solution includes dampener accessories mounted to the bowstring or bow assembly. While they may assist in lessening the vibrations, they are another of many various accessories that the user must consider. Depending on the size and complexity of such dampeners, they can negatively impact mobility and space required for hunting as well as projectile performance.

In light of the above, it would be a benefit in the art of archery weapons to provide a crossbow-type weapon that provides better balance, enhanced safety in handling, ease of cocking and uncocking the weapon, quiet operation and stealth. Thus, a projectile launcher solving the aforementioned problems is desired.

SUMMARY OF THE INVENTION

The projectile launcher includes a riser base, an elongate barrel assembly attached to the riser base, a crank mechanism attached to the back of the barrel assembly, a trigger assembly, and an internal bow assembly mounted to the riser base. The crank assembly includes a rotatable crank for selective reciprocation of a cocking pawl carriage riding inside a rail system in the barrel assembly. A biased cocking pawl in the pawl carriage selectively engages a projectile stirrup carriage riding on top of the rail system to push the stirrup carriage into a cocked position. The internal bow assembly includes vertically spaced upper and lower resilient bow arms and respective pulleys and cables interconnecting the bow arms and the stirrup carriage. Cocking the stirrup carriage flexes the bow arms in preparation for placement and firing of a projectile.

The working components of the projectile launcher are enclosed by a covering to protect the user. An integral quiver can also be provided.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
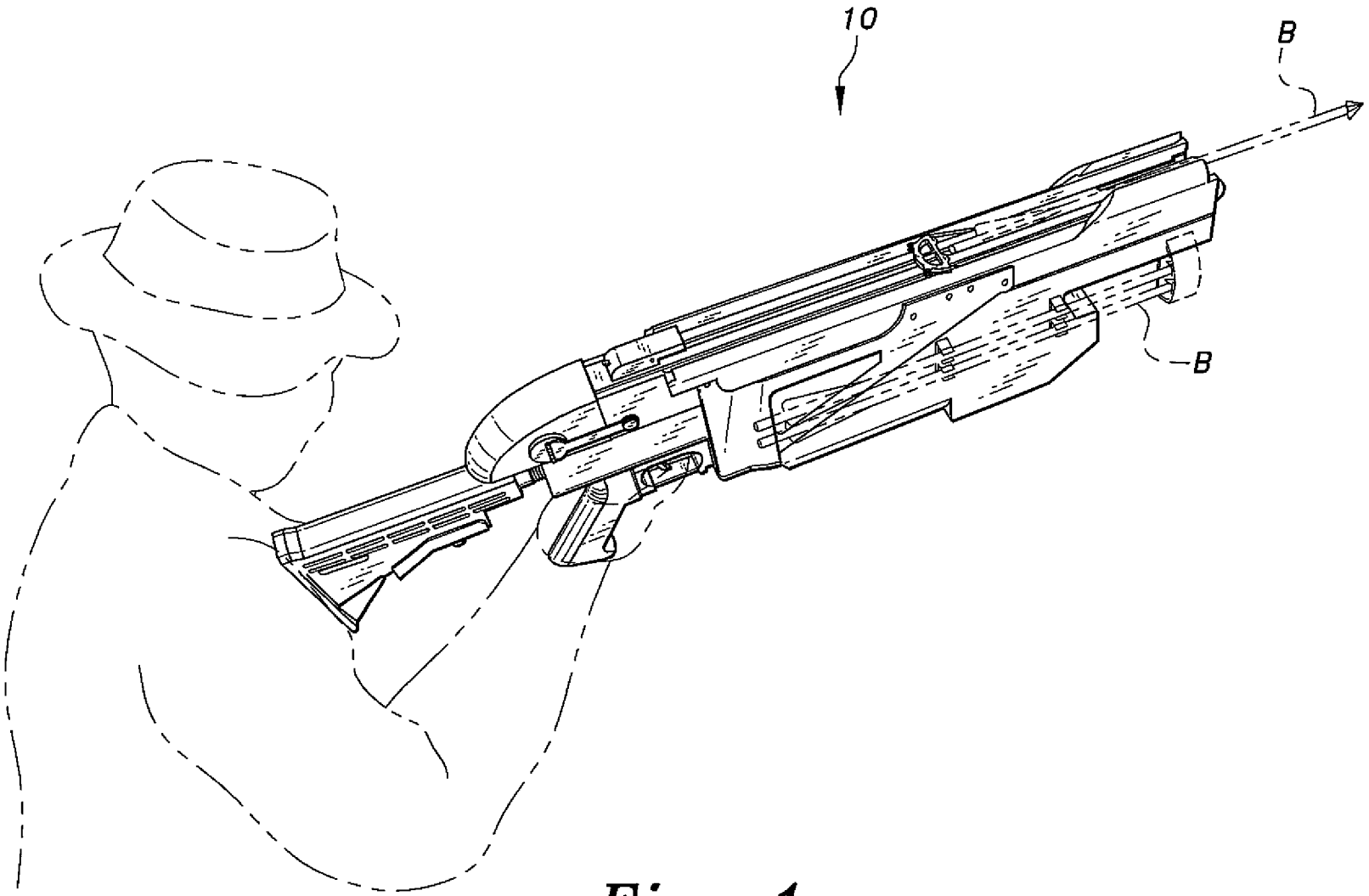
FIG. 1 is an environmental, perspective view of a projectile launcher according to the present invention.
Figure 2:
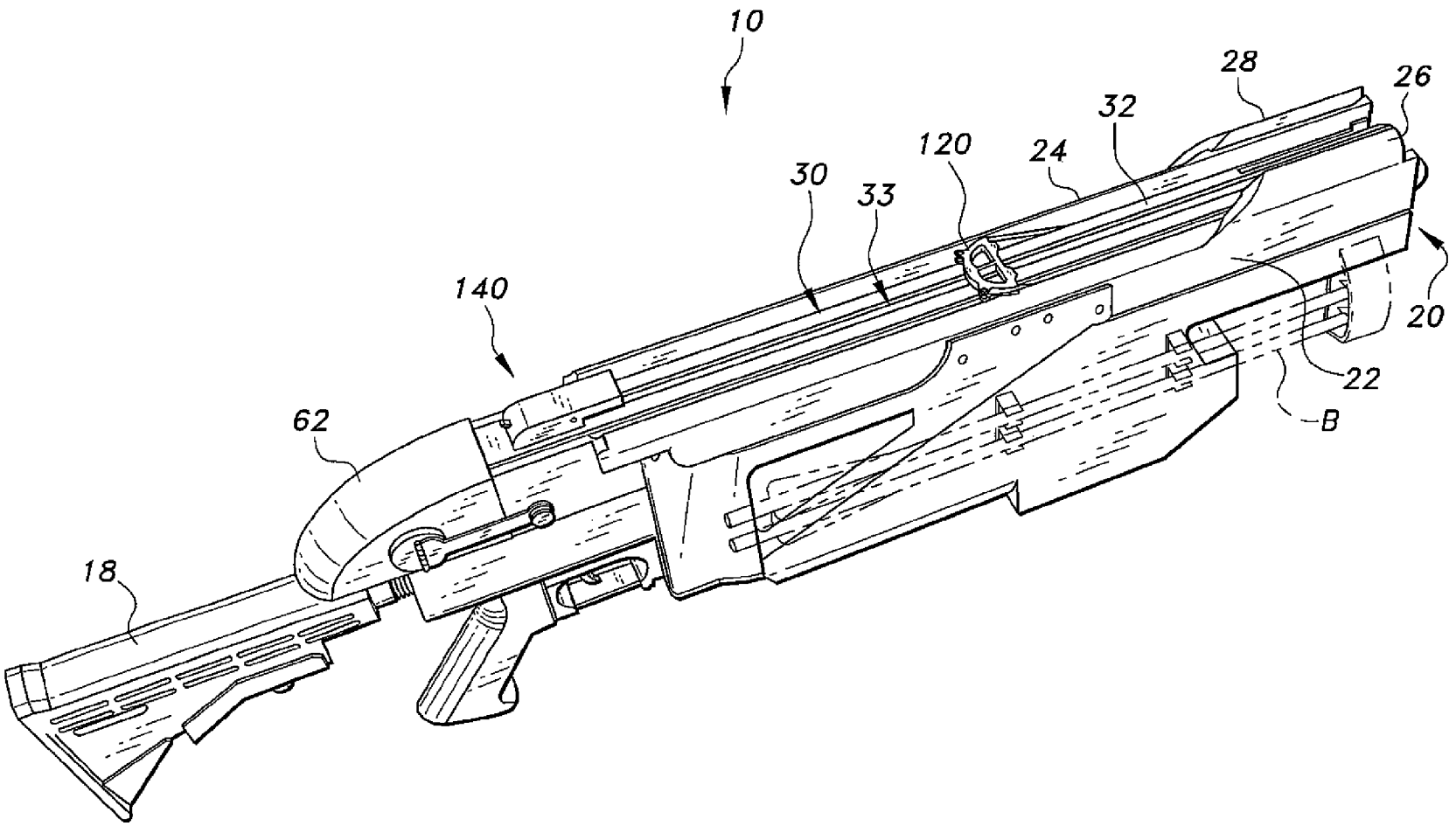
FIG. 2 is a perspective view of the projectile launcher of FIG. 1.

The projectile launcher, a first embodiment of which is generally referred to by the reference number 10, provides a well-balanced and enhanced, safe-handling/firing archery-type weapon in a relatively compact form. The term "projectile launcher" as used herein refers to a device capable of launching various types of elongate projectiles B, such as crossbow bolts, arrows, stakes, etc., that may be provided with either blunt or sharpened tips. As shown in FIGS. 1-4, the projectile launcher 10 includes a riser base 12 where the rest of the components of the projectile launcher 10 are mounted or attached. The riser base 12 is a substantially L-shaped block having a vertical short section 14 and an integral long section 16 extending transversely from an end of the short section 14. A portion of the long section 16 that meets with the short section 14 is notched, forming a mounting ledge 15 for mounting one of the bow limbs, the details of which will be further described below. The riser base 12 is preferably constructed from relatively lightweight, yet strong, durable material, such as aluminum, but other similar metals, wood, composites, and combinations thereof can also be used. The short section 14 is preferably solid, since this portion experiences the most stress, while the long section 16 includes an elongate slot 17 for passage of a trigger mechanism 140, to be described below. To reduce weight, portions of the short section 14 can be removed without adversely affecting the structural integrity, performance and function of this component. A stock 18 is detachably mounted to the distal end of the long section 16.

An elongate barrel assembly 20 is disposed along the top length of the long section 16. The barrel assembly 20 includes a pair of elongate side panels 22, 24 attached to sides of a rail system 30 disposed between the side panels 22, 24. The rail system 30 facilitates cocking and loosing of a projectile B, such as a crossbow bolt. The side panels 22, 24 are preferably elongate, rectangular plates having a height extending above the top surface of the rail system 30, thereby serving as side guards. Additionally, each side panel 22, 24 includes respective upwardly extending curved projections 26, 28 at the distal end. Each projection 26, 28 curves inwardly towards the central rail system 30, partially covering that end of the barrel assembly 20. These curved projections 26, 28 also serve as protective guards, providing limited cover over the sharp tip of the projectile B when cocked. Moreover, they can also serve as a crude, integral sight, similar to the aperture sights on typical firearms.

As best seen in FIGS. 2-6, the rail system 30 includes an elongate, upper rail section 32 and an elongate lower rail section 34. The front or distal end of the rail system 30 can be provided with resilient bumpers 38 to protectively support the front of the projectile launcher 10 during the cocking operation while the projectile launcher 10 is braced at its distal end against another object or the ground. The upper rail section 32 slidably supports a stirrup carriage 120 for the projectile B, while the lower rail section 34 slidably supports a cocking pawl carriage 41 for cocking the projectile launcher 10. Each rail section 32, 34 is preferably constructed from elongate square or rectangular tubes, one or both rail sections 32, 34 being complete or partial tubes, "partial" being construed as a channel having a C-shaped cross section. An elongate slot 33 is formed along the top length of the upper rail section 32 and serves as a flight groove for the projectile B. The slot 33 widens at the distal end of the upper rail section 32 in order to accommodate the head or tip of the projectile B. Although the widened section of the slot 33 is shown as a square or rectangular cutout, this section can be of any shape capable of permitting the tip of the projectile B to rest therein. The slot 33 also facilitates operation of a component of the cocking mechanism 40, which will be further described below.

The slot 33 preferably extends the whole length of the upper rail section 32. Alternatively, the extension of the slot 33 can stop short near the proximal end of the rail section 32. Any slot length can serve, so long as it provides proper support for the projectile B and permits operation of the cocking mechanism 40.

Figure 3:
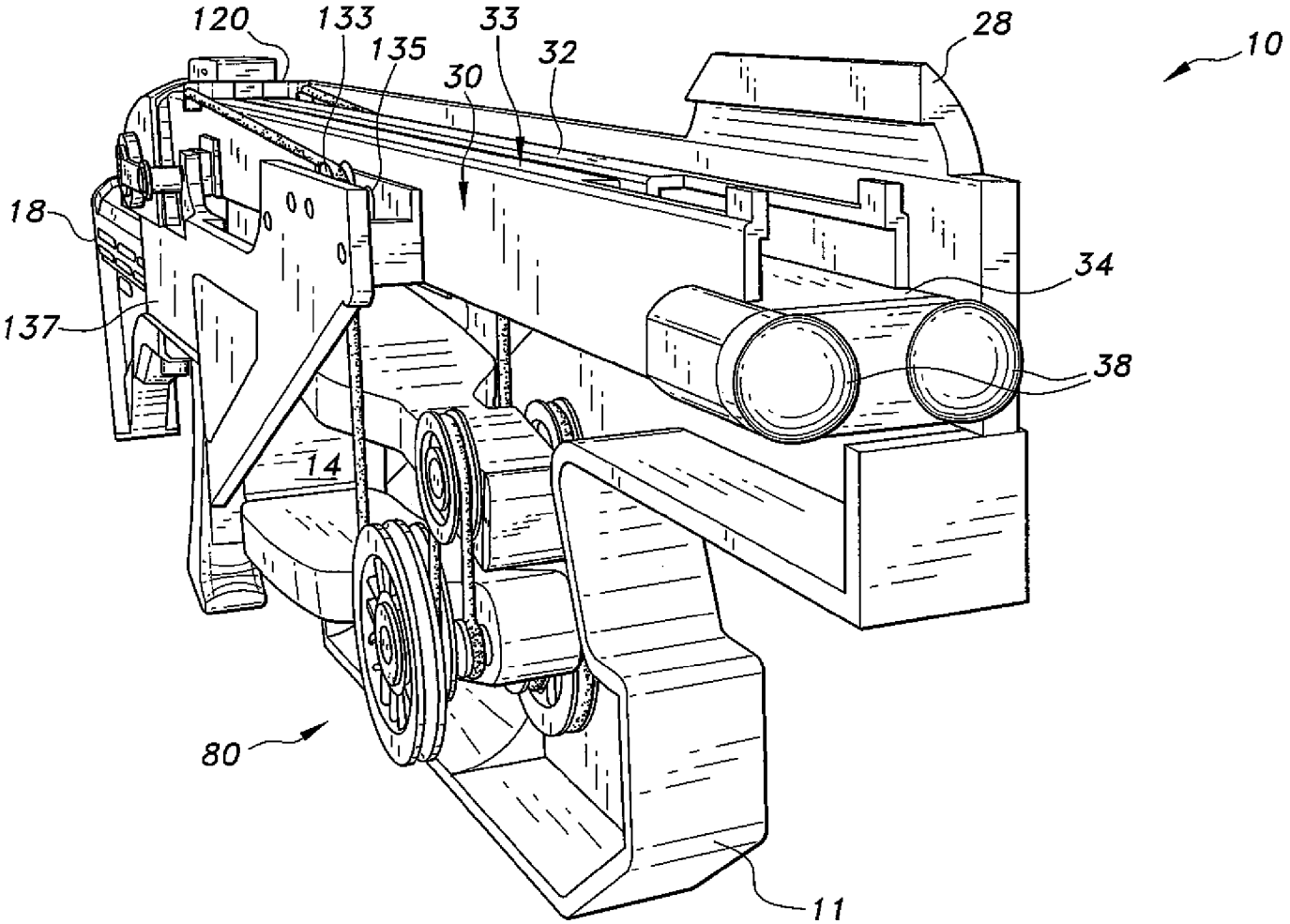
FIG. 3 is a perspective view of the projectile launcher of FIG. 2 as shown from the front and with part of the side housing removed to show details thereof.
Figure 5:
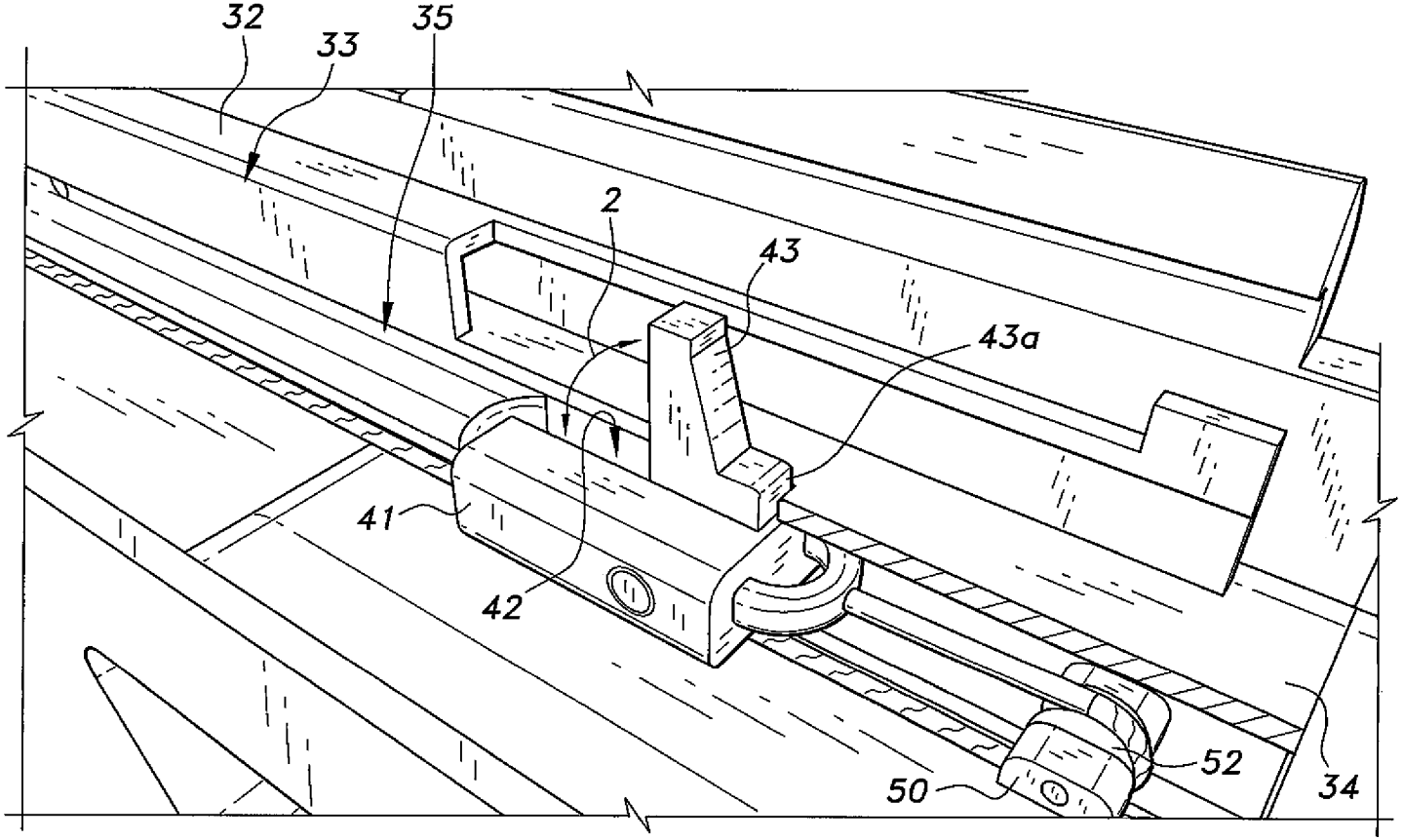
FIG. 5 is an enlarged partial perspective view of the front end of the projectile launcher of FIG. 2, shown with part of the side housing and rail system removed, showing details of the pawl of the cocking mechanism.
Figure 6:
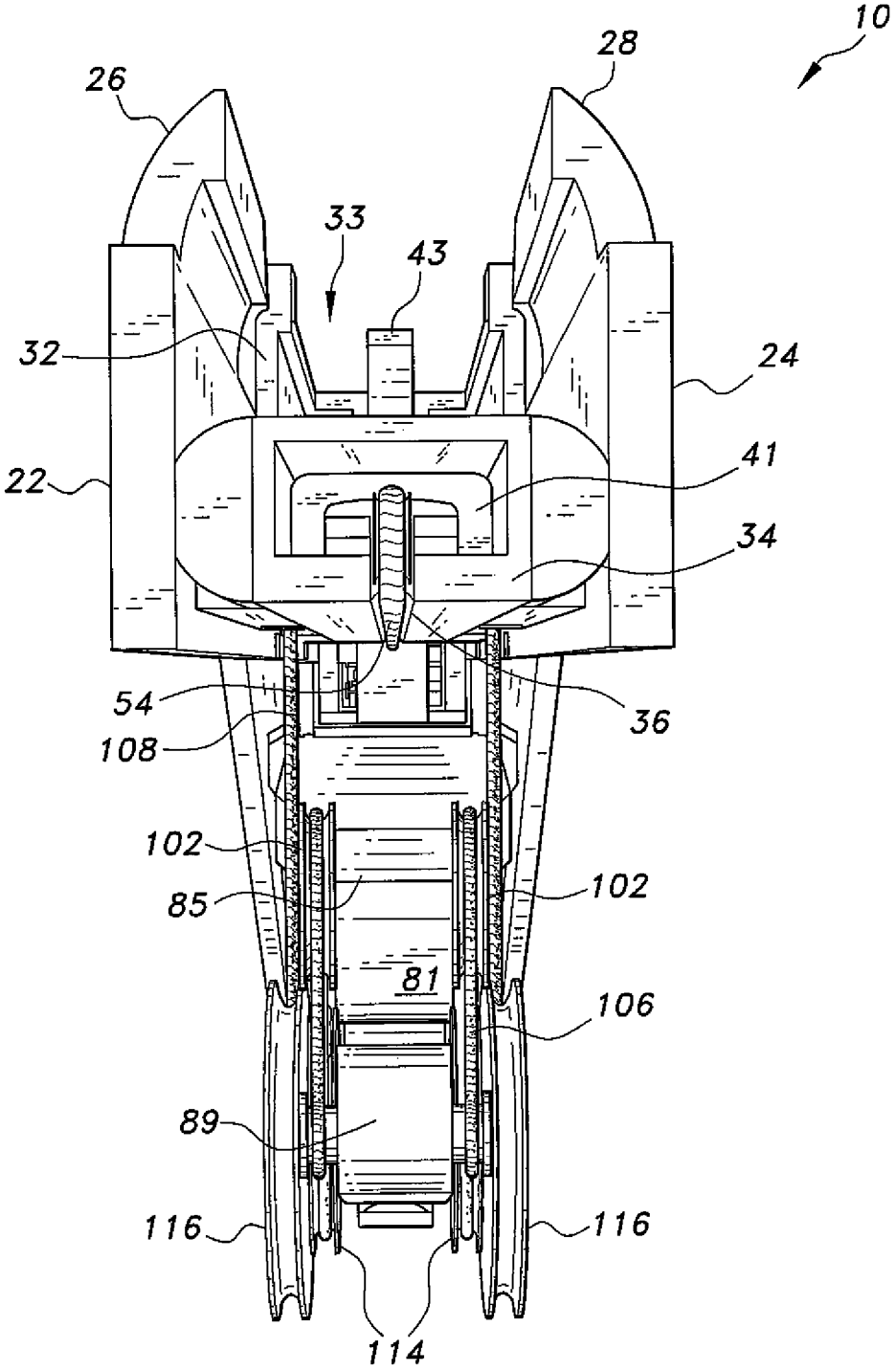
FIG. 6 is a front perspective view of the projectile launcher of FIG. 2, shown with part of the front housing removed.

As best seen in FIGS. 3 and 5, the interior edge of the slot 33 is preferably smooth and rounded to prevent any increased frictional engagement of the shaft when the projectile B is loosed. A non-smooth edge can potentially snag on the projectile B, reducing much of the energy imparted for flight. In the same vein, the surfaces of the slot 33 and/or the top surface of the upper rail section 32 can also be provided with a coating or a layer of friction-reducing material, such as Teflon® (Teflon is a registered trademark of E.I. Du Pont de Nemours and Company of Wilmington, Del.) and the like, in order to maximize the kinetic energy of the projectile B.

The top panel or portion of the lower rail section 34 also includes an elongate slot 35 collinear and parallel with the slot 33. The hollow interior of the lower rail section 34 accommodates slidable movement of a cocking pawl carriage 41, and the cocking pawl 43 in the pawl carriage 41 extends through both the slot 35 and the slot 33 to selectively engage the stirrup carriage 120 during the cocking operation.

Figure 7:
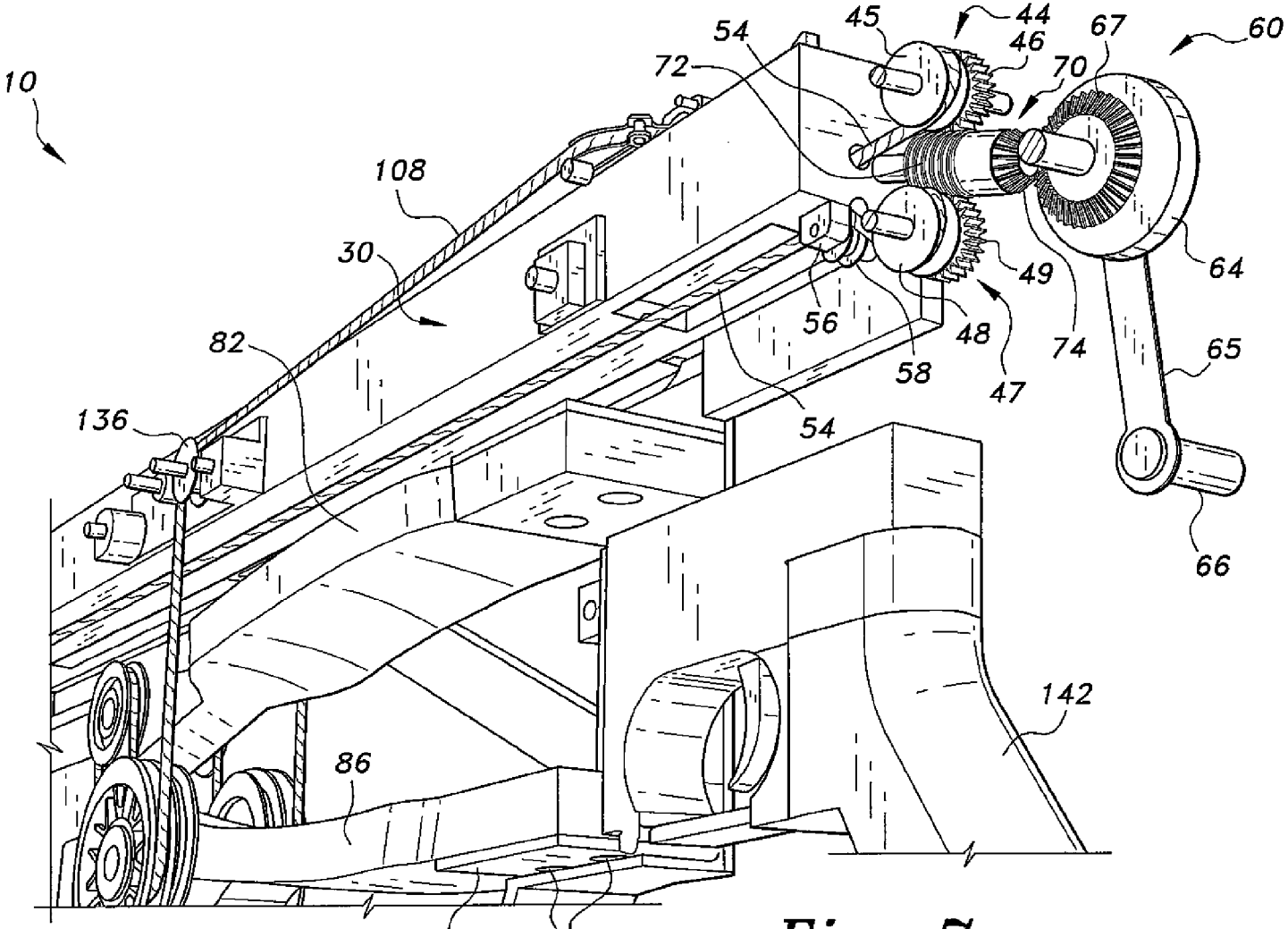
FIG. 7 is a rear perspective view of the projectile launcher of FIG. 2, shown with the side housing, riser base, and a portion of the trigger mechanism removed to highlight the crank mechanism.

The cocking mechanism 40 for the projectile launcher 10 includes a crank mechanism 60 mounted to the proximal end of the rail system 30 and the reciprocating cocking pawl carriage 41. A crank housing 62 encloses the working components of the crank mechanism 60. As best seen in FIG. 7, the crank mechanism 60 includes a crank 64 rotatably mounted to the crank housing 62. An elongate crank arm 65 is pivotally attached to one side of the crank 64 at one end, and a handle 66 protrudes transversely from the other end. The crank arm 65 is preferably constructed as an elongate plate, and the handle 66 is preferably shaped as an elongate, cylindrical post either rotatably mounted or non-rotatably fixed to the distal end of the crank arm 65. By this hinged construction of the crank arm 65, both the handle 66 and the crank arm 65 can be pivoted between use and non-use positions, where the former position extends the crank arm 65 radially outward, providing leverage for manual rotation, and the latter position stows the handle 66 into a corresponding hole on the side panel 22 when not in use. It is noted that either side panel 22, 24 or similar covering can be provided with a hole, depending on user preference, i.e., right- or left-hand operation. The pivoting crank arm 65 arrangement adds to the compact, streamlined form factor for the projectile launcher 10.

The opposite side of the crank 64 includes a coaxial bevel gear 67. This bevel gear 67 interacts with an elongate transmission gear assembly 70. The transmission gear assembly is preferably constructed as a substantially elongate post having a combination of gears formed thereon. One end of the transmission gear assembly 70 is rotatably mounted to the back of the rail system 30 and includes an intermediate worm gear 72 along a majority of the length of the post, and a bevel gear 74 at the opposite end. The bevel gear 74 of the transmission gear assembly 70 meshes with the bevel gear 67 of the crank 64. Thus, rotation of the crank 64 facilitates simultaneous rotation of the transmission gear assembly 70.

The connection of the transmission gear assembly 70 to the back of the rail system 30 can be provided by a simple rotating connection or by other like means, e.g., a non-circular boss that can be inserted into a correspondingly shaped mounting recess or hole where the attached end of the transmission gear assembly 70 can rotate with respect to the boss. This exemplary construction more securely mounts the transmission gear assembly 70 to the rail system 30. Other alternative constructions can also be utilized, such as a biased locking connection that permits removable mounting of the transmission gear assembly 70 while remaining free to rotate in response to the rotation of the crank 64. Additionally, a pair or more of the transmission gear assemblies 70 can be provided for ease of operation and/or increased mechanical advantage.

The cocking mechanism 40 also includes a first or upper pulley assembly 44 rotatably mounted inside the crank housing 62 above the transmission gear assembly 70, and a second or lower pulley assembly 47 rotatably mounted inside the crank housing 62 below the transmission gear assembly 70. Each pulley assembly is constructed as a combined, integral component having a pulley wheel coaxial with a gear. The pulley wheel can also be referred to as a pulley roller. Thus, the upper pulley assembly 44 includes a first or upper pulley wheel 45 integrally connected to a first or upper gear 46, while the lower pulley assembly 47 includes a second or lower pulley wheel 48 integrally connected to a second or lower gear 49. Each gear 46, 49 meshes with the worm gear 72 on the transmission gear assembly 70, and rotation of the worm gear 72 causes the upper and lower gears 46, 49 to concurrently rotate in opposite directions. In other words, when the upper gear 46 rotates clockwise via rotation of the worm gear 72, the worm gear 72 causes the lower gear 49 to simultaneously rotate counterclockwise, and vice versa.

One end of a cocking cable 54 is anchored to each upper pulley wheel 45 and lower pulley wheel 48. Both ends extend through corresponding holes at the back of the rail system 30 to wind around respective upper and lower pulley wheels 45, 48 as best seen in FIG. 7. Rotation of the upper and lower pulley wheels 45, 48 simultaneously winds and unwinds the cocking cable 54. The cocking pawl carriage 41 is attached to the cocking cable 54 at an intermediate section thereof and forced to move in response to the winding and rewinding rotations of the upper and lower pulley wheels 45, 48 on the cocking cable 54. Since the cocking pawl carriage 41 is slidably mounted inside the channel of the lower rail section 34, the cocking pawl carriage 41 is confined to reciprocate therein.

To facilitate the reciprocating movement of the cocking pawl carriage 41, the cocking cable 54 is trained around a distal, first idle pulley wheel or roller 52 rotatably mounted to a first mounting block 50 at the distal end of the lower rail section 34 and a proximal, second idle pulley wheel or roller 58 rotatably mounted to a second mounting block 56 at the proximal end of the lower rail section, as best shown in FIGS. 4-7. For simplicity of description, the trained arrangement of the cocking cable 54 is described as beginning from the upper pulley wheel 45. From the upper pulley wheel 45, a section of the cocking cable 54 extends into the channel of the lower rail section 34 and is attached to one end of the cocking pawl carriage 41. The remaining section of the cocking cable 54 extends from the other end of the cocking pawl carriage 41 and trains around the first idle pulley wheel 52 and the second idle pulley wheel 58 to connect with the lower pulley wheel 48. In order to insure proper movement of the cocking cable 54 during use, the bottom panel or wall of the lower rail section 34 can include an elongate guide groove 36 for guiding and defining the path of the cocking cable 54 to and from the lower pulley wheel 48. The guide groove 36 also assists in preventing fraying or damage to the cocking cable 54.

The cocking pawl carriage 41 includes an elongate, rectangular block having a recess 42 and a biased cocking pawl 43 pivotally mounted within the recess 42. The cocking pawl 43 can be constructed as an elongate, wedge-shaped bar normally biased to the upstanding position, as best seen in FIG. 5. The cocking pawl 43 includes an abutment extension 43*a* constructed to interact with the slot 35 in the lower rail section 34. The surfaces of the cocking pawl carriage 41 and/or the interior surfaces of the channel in the lower rail section 34 can be provided with a coating or layer of friction reducing material, such as Teflon, in order to insure smoothness and ease of sliding movement.

In use, the projectile launcher 10 is placed so that the bumpers 38 at the front of the projectile launcher 10 rest on the ground or any suitable bracing surface or object. The cocking pawl 43 normally extends upright so that operation of the crank mechanism 60 in one direction slides the cocking pawl carriage 41 until the cocking pawl 43 engages the front of the projectile stirrup carriage 120. Continuous cranking causes the cocking pawl 43 to push the stirrup carriage 41 towards the rear or proximal end of the barrel assembly 20 until the stirrup carriage 120 is in the fully cocked position. At this point, the projectile stirrup carriage 120 is locked in place by, e.g., releasable catches or fingers 146 of the trigger assembly 140. Prior to releasing the catches 146, the crank mechanism 60 is rotated in the opposite direction, causing the cocking pawl carriage 41 to slide back towards the front or distal end of the barrel assembly 20. Towards the end of the backwards travel, the abutment extension 43*a* abuts against the end of the slot 35, forcing the cocking pawl 43 to pivot down into the recess 42, as indicated by the arrow 2 in FIG. 5. This allows the cocking pawl 43 to clear the slot 33 in the upper rail section 32, permitting unobstructed placement and passage of the projectile B to be loosed. At least this end of the slot 35 is preferably closed to facilitate the abutted pivoting motion of the cocking pawl 43. However, this end of the slot 35 can also be constructed in a variety of shapes, such as the end having sloping sides, a stepped end portion, and the like that provide some sort of obstruction for interacting with the abutment extension 43*a*.

Figure 4:
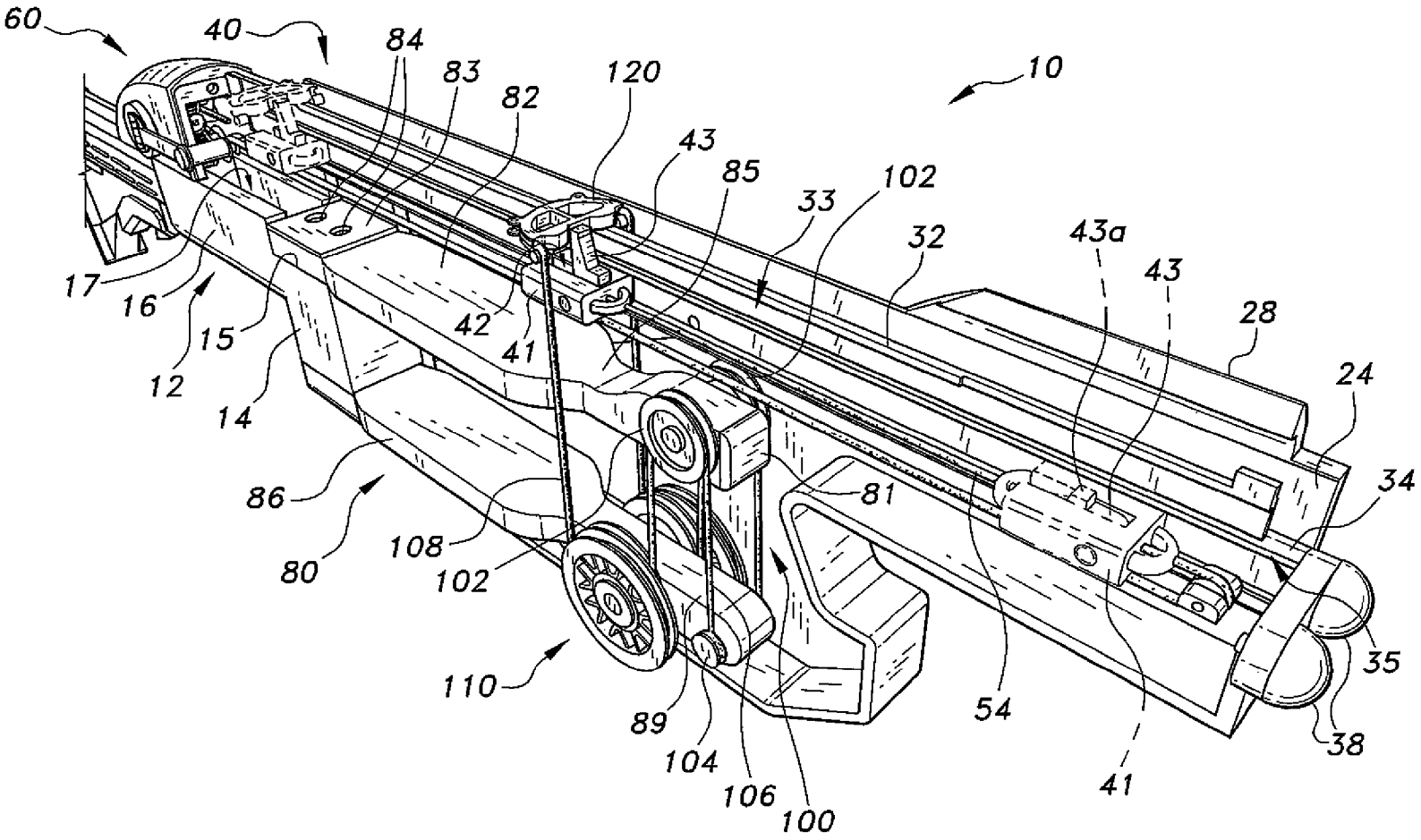
FIG. 4 is a partial perspective view of the projectile launcher of FIG. 2, shown with the side housing and part of the rail system removed.
Figure 8:
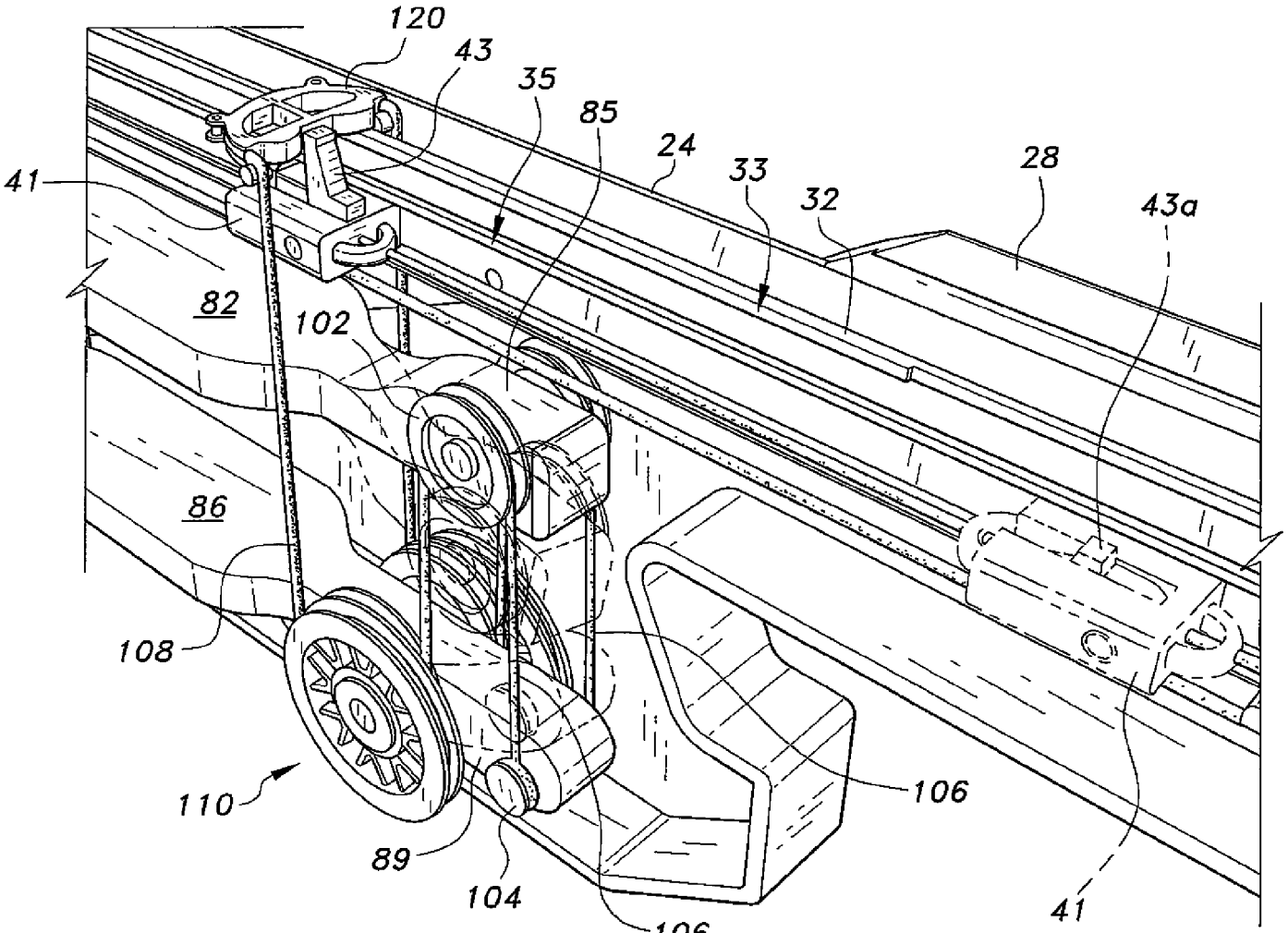
FIG. 8 is a partial perspective view of the projectile launcher of FIG. 2, showing details of the internal bow limbs and the cocking mechanism.

The kinetic energy for propelling the projectiles B is provided by a bow assembly 80 attached to the riser base 12. The term "bow assembly" is used because it includes bow elements that tension connected cables and transfer the energy stored therein to accelerate the projectile B in a manner similar to various archery weapons. Unlike conventional crossbows, the bow assembly 80 is configured in a reversed and vertical orientation as opposed to front-facing and horizontal. Moreover, the projectile launcher 10 is provided with a covering 11 that encloses the bow assembly 80 and associated components, which protects the bow assembly 80 from the elements and provides a safety feature for the user. Any noise that may be generated by the operation of the bow assembly 80 will also be muffled by the covering 11. This configuration of the bow assembly 80 provides the projectile launcher 10 with a compact, streamlined form, which eliminates the potential hindrances of horizontally extending bow arms in conventional crossbows. As shown in FIGS. 4, 7 and 8, the bow assembly 80 includes a flexible, resilient upper bow arm, limb or lath 82 attached to the mounting ledge 15 on the vertical short section 14, and a flexible, resilient lower bow arm, limb or lath 86 attached to the bottom of the short section 14.

The upper bow arm 82 is constructed as an elongate, flat beam having one end secured to the mounting ledge 15 by an upper mounting plate 83 and bolts 84. The upper bow arm 82 includes a relatively wide section that tapers to a relatively short, narrow section 85.

Similarly, the lower bow arm 86 is constructed as an elongate, flat beam having one end secured to the bottom of the short section 14 by a lower mounting plate 87 and bolts 88. The lower bow arm 86 includes a relatively wide section that tapers to a relatively short, narrow section 89. Although both the upper and lower bow arms 82, 86 include wide and narrow sections, the bow arms 82, 86 are not identically shaped due to the bow flexing assembly 100 attached to the narrow sections 85, 89. However, the different width sections are generally preferred for each bow arm 82, 86, where the wide section provides the durability and strength for flexure and the narrow section eases flexing of the bow arms 82, 86. Alternative constructions, such as a beam with continuous tapering sides and the like, can also be used for similar purpose. In general, the sizes and shapes of the upper and lower bow arms 82, 86 can be selected in concert with the flexing assembly 100 configuration and mass distribution to create the required energy storage and minimized center of mass shifts during firing, as described more below. Thus and alternatively, identical upper and lower bow arms 82, 86 can be employed with corresponding accommodation of the flexing assembly 100.

Figure 9:
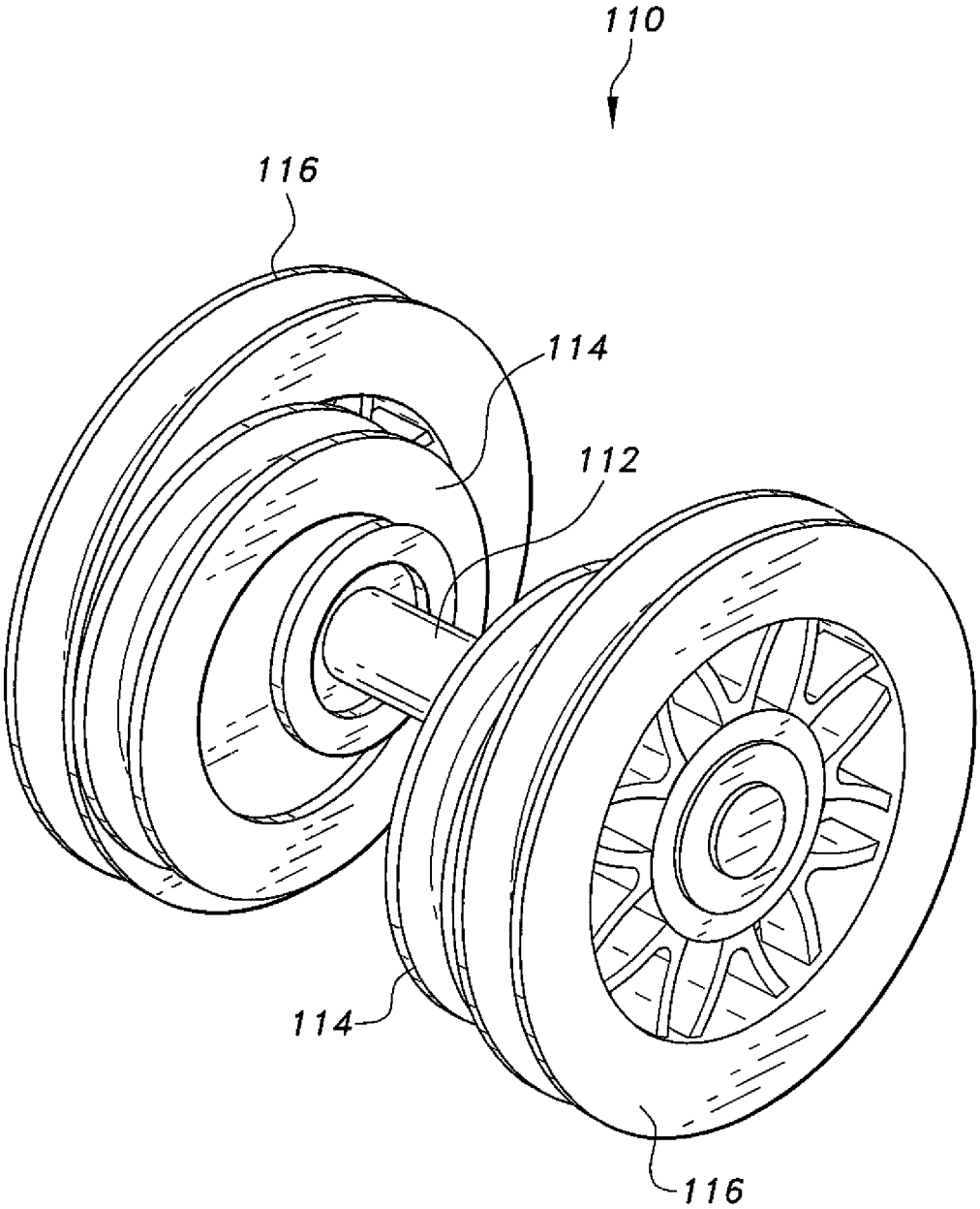
FIG. 9 is a perspective view of a cam pulley wheel assembly for the projectile launcher of FIG. 2.

The flexing assembly 100 includes a pair of outer, upper pulley wheels or rollers 102 rotatably mounted near the distal end of the upper narrow section 85 and a cam pulley assembly 110 rotatably mounted to the lower narrow section 89. The cam pulley assembly 110 (best seen in FIG. 9) includes a rotatable shaft 112, a pair of inner pulley wheels or rollers 114 and a pair of outer pulley wheels 116. The inner pulley wheels 114 are rigidly attached to the shaft 112 at an offset or eccentric axis. When assembled, the inner pulley wheels 114 reside on the sides of the lower narrow section 89. Each inner pulley wheel 114 has a given, preselected diameter. Each outer pulley wheel 116 is coaxially mounted to respective ends of the shaft 112 adjacent to respective inner pulley wheels 114. The diameter of the outer pulley wheels 116 is preferably larger than the inner pulley wheels 114. Due to the eccentric axial mounting of the inner pulley wheels 114, rotation of the outer pulley wheels 116 causes a corresponding cam rotation of the inner pulley wheels 114. Unlike a traditional compound crossbow mechanism that has analogous but loosely synchronized pairs of inner and outer pulley wheels, the rigid attachment of the inner and outer pulley wheels 114, 116 to the shaft 112 ensures that rotational synchronization of the flexing assembly 100 is maintained at all times, which improves shooting accuracy by ensuring consistent tensioning of the attached cables for firing the projectile B.

Each pair of inner and outer pulley wheels 114, 116 can be constructed as separate components. However, they are preferably integrally fixed to each other by some means, such as fasteners or adhesive, in order to preserve the desired camming effect. A more preferred construction includes a molded or machined pair of inner and outer pulley wheels 114, 116. The wheels preferably include a plurality of cutouts to minimize weight and rotational inertia.

The flexing assembly 100 is also provided with a pair of first flex cables 106. Each first flex cable 106 is anchored at one end to an anchor stub 104 disposed on the sides of the lower narrow section 89 at the end thereof. The remainder trains over the upper pulley wheels 102 and down towards the lower, inner pulley wheels 114, where the opposite end of the respective first flex cable 106 anchors thereon. A second flex cable 108 has each end anchored to respective outer pulley wheels 116 of the cam pulley assembly 110. The second flex cable 108 extends from one outer pulley wheel 116 and trains around the projectile stirrup carriage 120 to the other outer pulley wheel 116. Alternatively, the second flex cable 108 can be provided as two equal length cables with each being anchored to a respective outer pulley wheel 116 at one end and the other end anchored to a corresponding side of the stirrup carriage 120. The interaction between the flex cables and the pulley wheels flexes the bow arms 82, 86 to be further described below.

Figure 10:
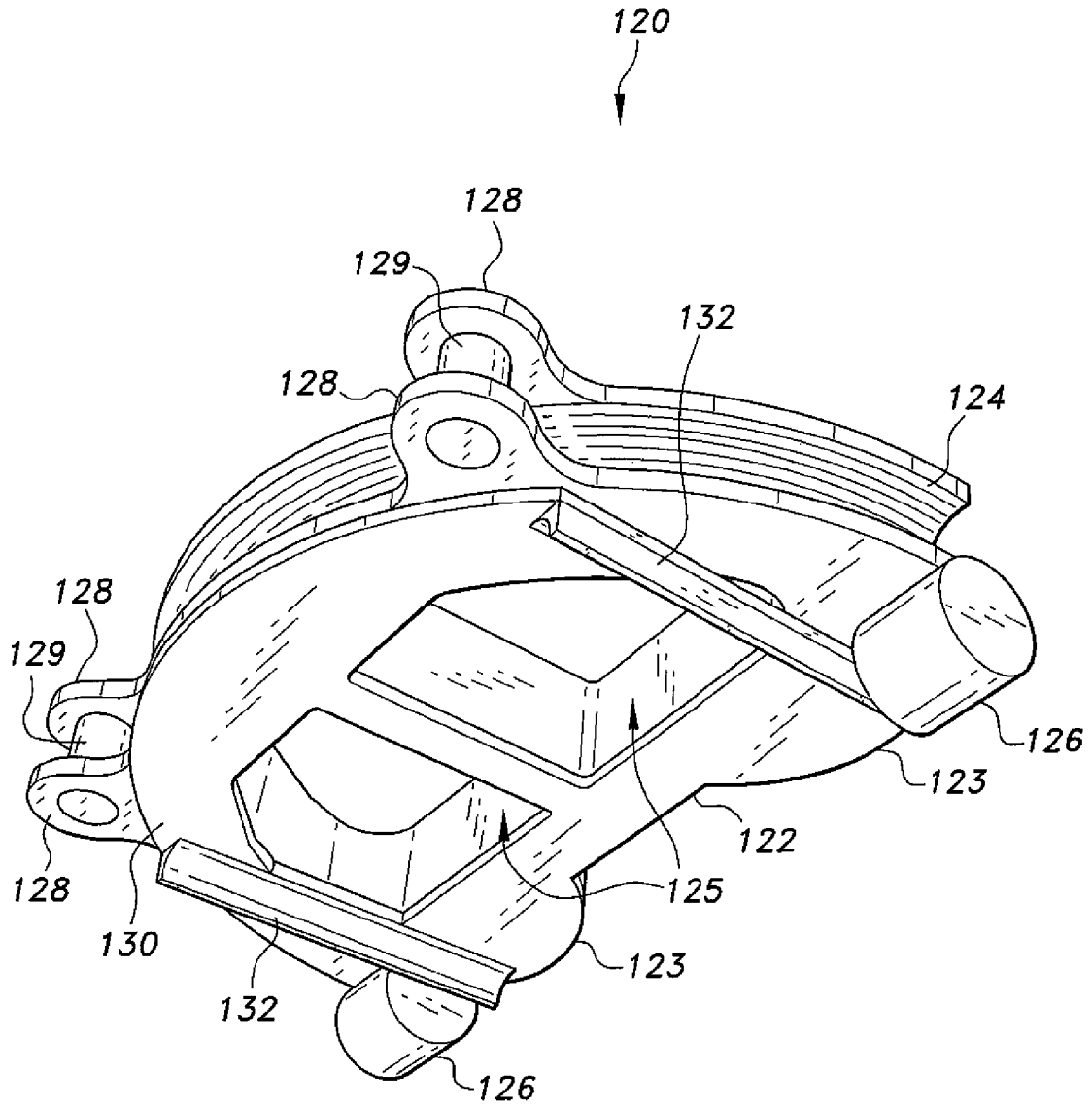
FIG. 10 is a bottom perspective view of a stirrup carriage for the projectile launcher of FIG. 2.
Figure 11:
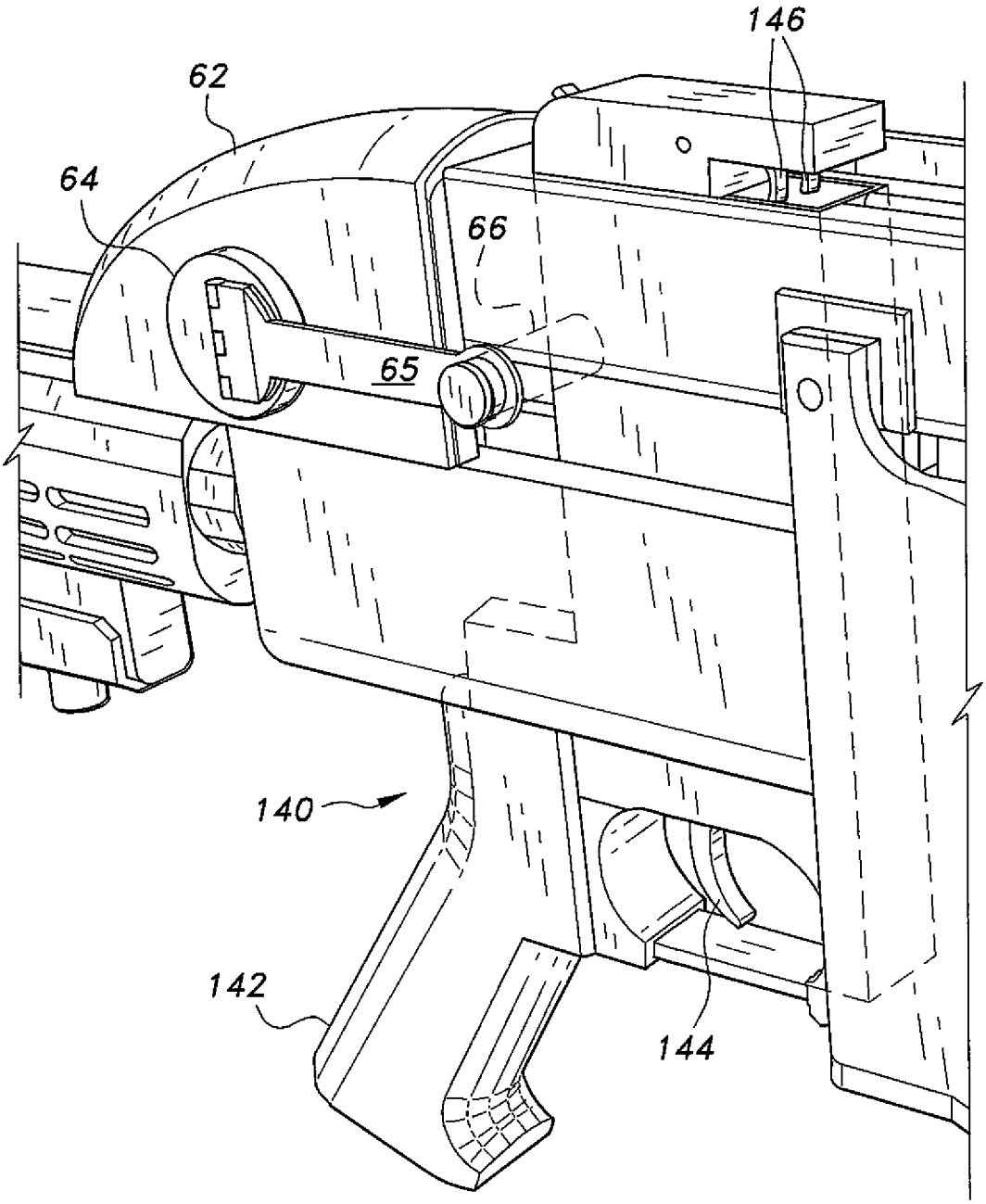
FIG. 11 is a partial perspective view of the projectile launcher of FIG. 2, showing the crank for the cocking mechanism.

The projectile stirrup carriage 120 is best shown in FIG. 10. As shown, the projectile stirrup carriage 120 is constructed as a relatively thin, hemi-circular block with a relatively flat front 122 and a curved or arcuate outer edge. The front 122 includes a flat portion for accommodating the cocking pawl 43 during the cocking operation. Additionally, the flat portion serves as an abutment for the back of the projectile B when the projectile launcher 10 is ready to be fired. A completely flat front may be serviceable, but to insure safe operation, the stirrup carriage 120 can include a pair of outwardly projecting front guide protrusions 123, with the flat portion disposed therebetween. The guide protrusions 123 assist in insuring proper placement of the rear end of the projectile B and prevent lateral movement thereof. Any lateral play that may exist with respect to the operation of the cocking pawl 43 will also be prevented by the guide protrusions 123. Additionally, the guide protrusions 123 provide increased longitudinal support to prevent the projectile stirrup carriage 120 from tumbling during high accelerated travel along the upper rail section 32. The projectile stirrup carriage also includes a pair of cutouts 125 for receiving the catches 146 of the trigger assembly 140 as well as to minimize weight.

A guide groove 124 is formed along the curved outer edge, upon which the second flex cable 108 trains around the stirrup carriage 120 and is connected thereby. In order to secure the trained connection, the stirrup carriage 120 includes a pair of guide roller stubs 126 and two pairs of angularly spaced, radially projecting support tabs or extensions 128, each pair of support tabs 128 supporting a guide roller 129 therebetween. The guide roller stubs 126 can be constructed as non-rotating cylindrical stubs disposed at the bottom of the stirrup carriage 120 on opposite ends of the substantially flat front 122. Alternatively, the guide roller stubs 126 can be rotatable. Each pair of support tabs 128 includes an upper and lower support tab, the guide roller 129 being mounted between the tabs. As with the guide roller stubs 126, the guide roller 129 can be rotatable or non-rotatable. Any number of pairs of support tabs 128 can be provided for the stirrup carriage 120. In use, the second flex cable 108 trains around the guide roller stubs 126 into the guide groove 124, where the guide roller 129 traps the second flex cable 108 and prevents any unintentional dislodging of the flex cable 108.

Since the projectile stirrup carriage 120 is configured to slide along the top of the upper rail section 32 at varying speeds, the projectile stirrup carriage 120 is also provided with a wear plate 130 at the bottom of the carriage 120. Preferably, the wear plate 130 is constructed from friction-reducing material to increase longevity and operational effectiveness for transferring kinetic energy to the projectile B. A pair of guide rails 132 extends from opposite, lateral ends of the wear plate 130. These guide rails 132 straddle the lateral sides of the upper rail section 32 and ensure that the projectile stirrup carriage 120 travels along the upper rail section 32. The top of the upper rail section 32 can also be provided with a coating or layer of friction reducing material.

In order to redirect the vertical force created by the bow assembly 80 working with the flex assembly 100 and transmitted via the second flex cable 108 into a horizontal force applied to the projectile stirrup carriage 120, the projectile launcher 10 also includes a plurality of side idler guide rollers 133, 136 rotatably mounted between the rail system 30 and rail system support frame 137 that projects from and is attached to the short vertical section 14. The second flex cable 108 is confined between the guide rollers 133, 136, which ensure that only a portion of the second flex cable 108 deflects between the longitudinal ends of the rail system 30.

The trigger assembly 140 includes a detachably mounted block having a grip 142, a trigger 144, and a pair of catches or fingers 146 disposed near the top of the block. The trigger assembly extends through the slot 17 of the rail system 30, and the releasable catches 146 engage the cutouts 125 when the stirrup carriage 120 is in the cocked position. Pulling the trigger 144 releases the catches 146. The top of the trigger assembly 140 or the crank housing 62 can be provided with a mounting system (not shown) for mounting scopes and other similar sights to assist aim.

In operation, the cocking pawl 43 pushes the stirrup carriage 120 back towards the trigger assembly 140 against the resistance of the second flex cable 108. The movement of the stirrup carriage 120 causes the second flex cable 108 to pull away from the outer pulley wheels 116, thereby rotating the same. Rotation of the outer pulley wheels 116 simultaneously rotates the inner pulley wheels 114. This action winds the first flex cables 106 around the inner pulley wheels 114, forcing the upper and lower narrow sections 85, 89 of the upper and lower bow arms 82, 86 to flex toward each other. At this point, the projectile stirrup carriage 120 is cocked and ready to be released. Upon release of the catches 146 by the user pulling the trigger 144, the built-up tension in the second flex cable 108 is released causing the projectile stirrup carriage 120 to rapidly accelerate along the upper rail section 32 towards the front thereof. This action launches the projectile B carried by the projectile stirrup carriage 120.

Unlike modern conventional crossbows, the projectile launcher 10 can be dry-fired without risk of damage to the bow assembly 80 due to the mass of the projectile stirrup carriage 120. If a user dry-fires such a conventional crossbow, the kinetic energy transfers back into the bowstring and the various components of the crossbow, rather than to the bolt. With some crossbows having a draw weight in the hundreds of pounds, that is a considerable amount of energy to be absorbed. This leads to potential damage, such as breaks in the bow limbs and/or bowstring, failure or breakage in the cams and pulleys, etc., which can potentially result in flying parts that can harm the user. In contrast, the mass of the projectile stirrup carriage 120 acts as a focus for dissipating the released energy as it travels towards the front of the rail system 30 past the normal position at the midpoint of the rail system 30 and decelerates at the end of the firing cycle. In other words, the momentum of the projectile stirrup carriage 120 towards the end of travel, i.e., the distal end of the rail system 30, pulls against or counteracts the natural rebounding flexure of the bow arms 82, 86, thereby dissipating the potential energy after firing. While benefiting dry-firing conditions, this effect occurs to a lesser degree in normal firing conditions. The stirrup carriage 120 will still overrun its normal midpoint position when firing a projectile B, and any residual energy will be dissipated by the overrun. This overrun of the bolt stirrup carriage 120 at the completion of firing also has the effect of eliminating vibration in the second flex cable 108, which can generate unwanted noise. Thus, an extremely quiet operation can be facilitated. The string/cable vibration at the end of firing in a traditional crossbow is more than an annoyance, and reduces the desired stealth of operation that is highly prized in hunting applications. It is noted that this anti-vibration effect occurs in both firing and dry-firing conditions.

The pulley system in the bow assembly 80 functions in a similar manner to conventional compound bows. The cam pulley assembly 110 allows the bow arms 82, 86 to be drawn and the draw to be maintained without continuous effort, as in non-compound bows. Depending on the desires or requirements of the user, the cam pulley assembly 110 and/or the upper, outer pulley wheels 102 can be constructed with various different cam profiles to facilitate the desired draw characteristics.

In addition, the bow arms 82, 86 have been mentioned as being not necessarily identical, as well as that the components of the flexing assembly 100 mounted onto the bow arms 82, 86 may be of generally different masses. Therefore, the aggregate center of mass of the combined bow assembly 80 and flexing assembly 100 may translate in the vertical plane during cocking and firing operation. In other words, the different configuration of the upper and lower bow arms 82, 86 and flexing assembly 100 mounting configuration could cause the releasing momentum to be directed at an angle from the aim line. In order to compensate, the combined bow assembly 80 and flexing assembly 100 are constructed to be dynamically balanced such that their aggregate center of mass is invariant in the vertical plane during cocking and firing operation. For example, the upper bow arm 82 can be provided with a weighted end 81 and/or larger cross section to the upper narrow section 85. In addition, the materials for constructing the bow arms 82, 86 can be selected and assembled to provide the desired flex and balance. Moreover, the masses of the upper pulley wheels 102, and inner and outer pulley wheels 114, 116 can be tuned by adjustment of thickness, size of cut-outs, etc. to create the desired mass distribution in combination with the aforementioned adjustments.

Thus, it can be seen that the projectile launcher 10 provides an unencumbered and easy to operate crossbow-like weapon in a significantly more compact and streamlined form. Since the working components of the projectile launcher 10 are enclosed or confined within a guarded or protected structure, the user can operate and fire the projectile launcher 10 without much of the safety and operational concerns of conventional crossbows. Moreover, the reversed and vertically oriented internal bow assembly 80 and associated structural support and the placement thereof results in a balanced weapon, enhancing portability, operation, and aim.

Figure 12:
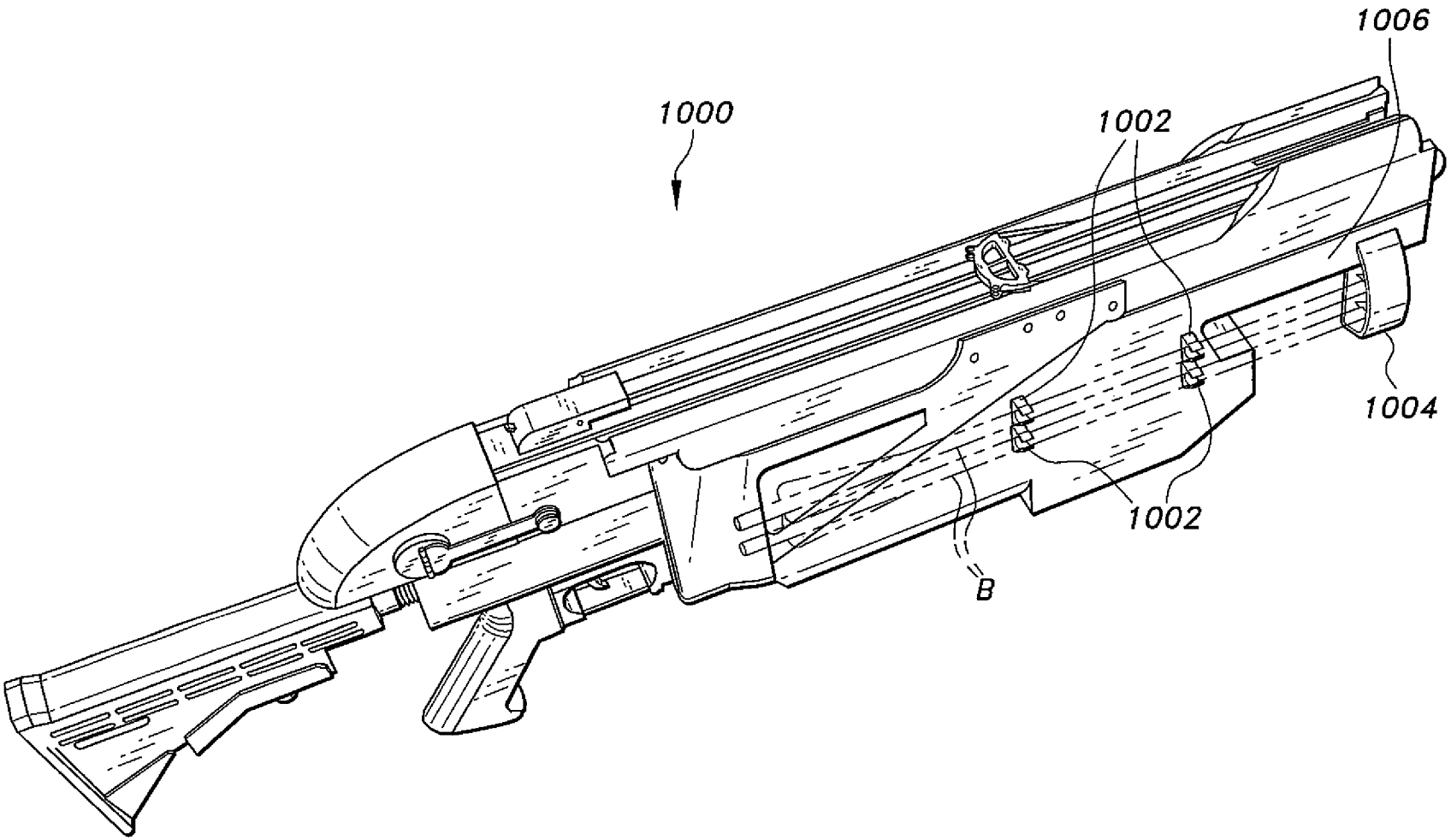
FIG. 12 is a top perspective view of an alternative embodiment of a projectile launcher according to the present invention having an integral quiver assembly.
Figure 13:
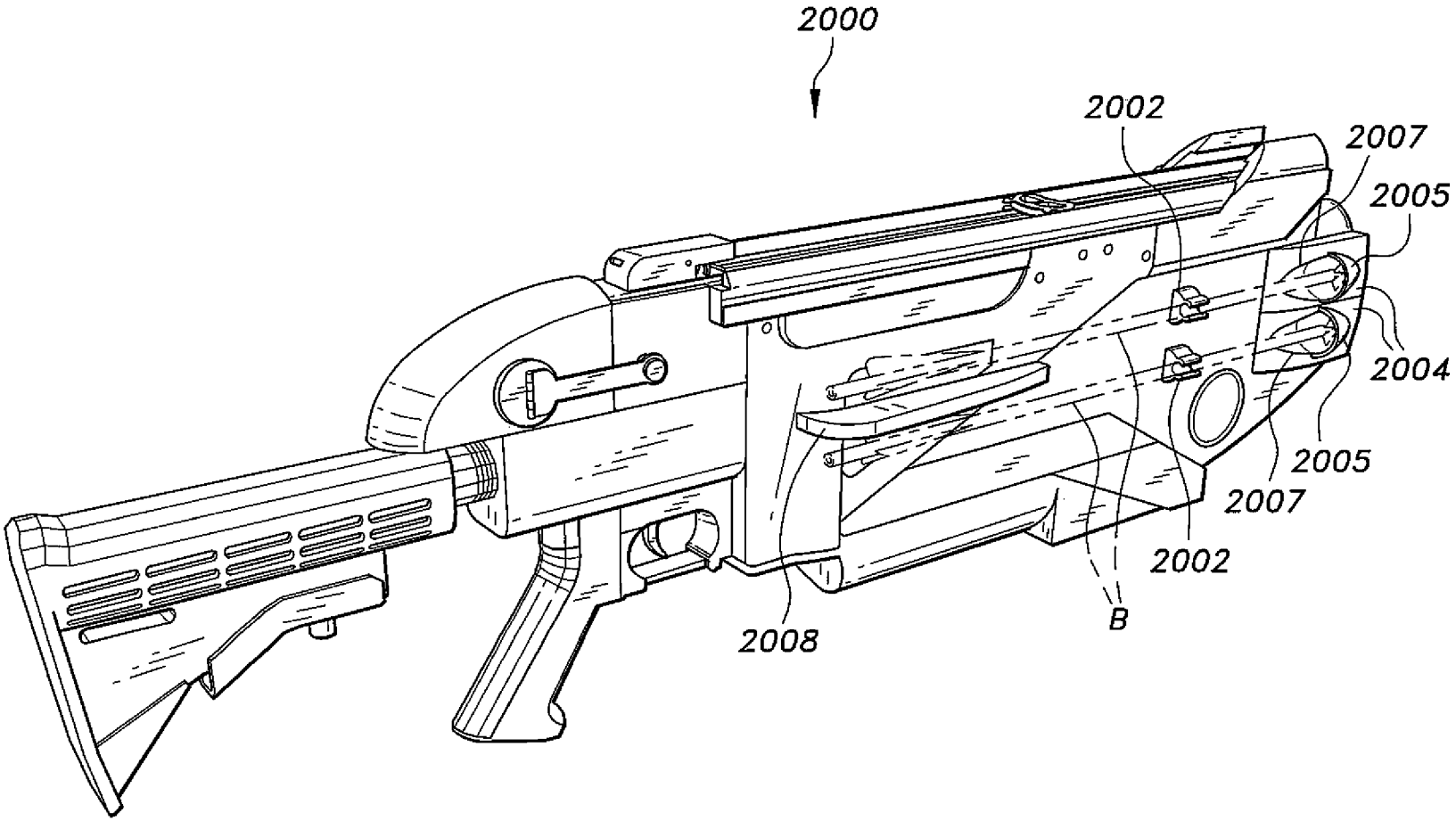
FIG. 13 is a top perspective view of another alternative embodiment of a projectile launcher according to the present invention having an integral quiver assembly.

Turning to FIGS. 12 and 13, these drawings show alternative embodiments having integral quivers. As shown in FIG. 12, the projectile launcher 1000 includes a plurality of spaced projectile clamps or grips 1002 disposed on the sides of the covering 1006. These projectile clamps 1002 permit projectiles B, such as a crossbow bolt, to be secured thereon. The front end of the projectile launcher 1000 also includes an integral projectile head guard 1004 hanging or depending therefrom. The projectile head guard 1004 is a housing that provides a protective cover for the crossbow projectile tip or head. In use, the user places the tip or head of the projectile B into the opening of the projectile head guard 1004 prior to securing the same to the clamps 1002.

As shown in FIG. 13, the projectile launcher 2000 includes a plurality of spaced projectile clamps or grips 2002 disposed on the sides of the covering 2006. These projectile clamps 2002 permit projectiles B, such as a crossbow bolt, to be secured thereon. The front end of the projectile launcher 2000 also includes an integral projectile head guard 2004 at the front end of the projectile launcher 2000. Each projectile head guard 2004 includes a curved cover 2005 overlaying a scalloped recess 2007. The scalloped recess 2007 provides room for receiving the tip or head of the projectile B, while the cover 2005 protects the same from the environment and the user. The projectile launcher 2000 can also include a fin 2008 disposed between adjacent projectiles B to assist in maintaining separation thereof and protecting the fletching from damage due to potential contact with the environment and user.

Figure 14:
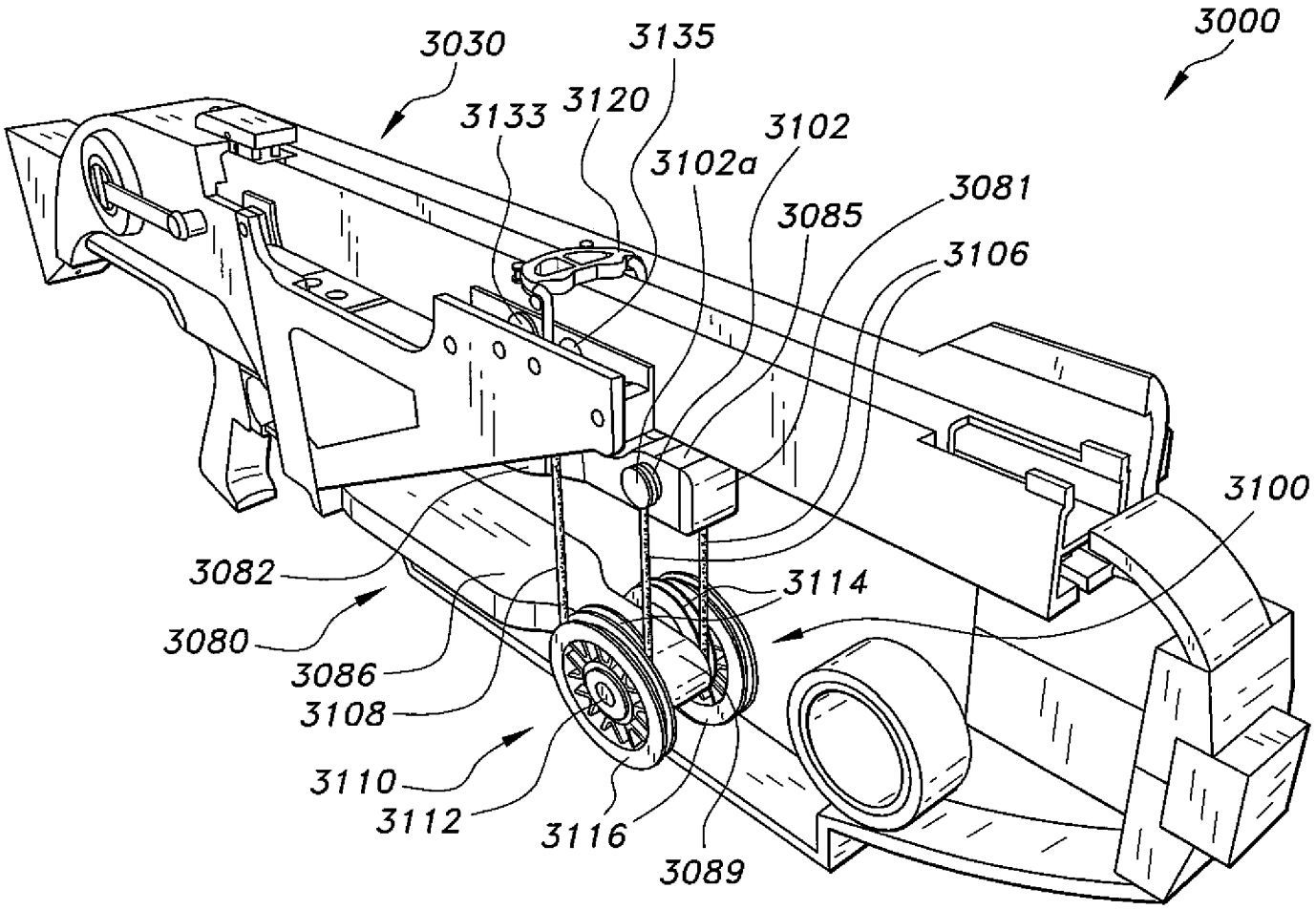
FIG. 14 is a perspective view of another alternative embodiment of a projectile launcher according to the present invention, shown with the side housing removed.

Another embodiment of a projectile launcher is shown in FIG. 14. Initially, it is noted that the following description and corresponding reference numbers will be primarily focused on features different from the previous embodiments for clarity and brevity.

As best shown in FIG. 14, the projectile launcher 3000 is configured and functions substantially the same as the previously described projectile launcher 10. In that regard, the projectile launcher 3000 includes a rail system 3030, a projectile stirrup carriage 3120 slidably attached to the rail system 3030, and a bow assembly 3080 disposed below the rail system 3030 and operatively connected to the stirrup carriage 3120, the bow assembly 3080 selectively storing the potential energy and releasing the same in order to provide the kinetic energy for firing a projectile supported on the stirrup carriage 3120. The previously described riser base 12, cocking mechanism 40, trigger mechanism 140 and other associated features therewith are incorporated in the projectile launcher 3000 and have not been specifically referenced with corresponding reference numbers in FIG. 14. Additionally, the bow assembly 3080 and the other bow assemblies described herein can also be referred to as a propulsion system for selectively storing potential energy during a cocking operation and releasing the potential energy as kinetic energy when fired.

The bow assembly 3080 is configured in a reversed and vertical orientation, as opposed to front-facing and horizontal in most conventional crossbows. The bow assembly 3080 includes a flexible, resilient upper bow arm, limb or lath 3082 attached to the mounting ledge 15 on the vertical short section 14, and a flexible, resilient lower bow arm, limb or lath 3086 attached to the bottom of the short section 14.

The upper bow arm 3082 is constructed as an elongate, flat beam having one end secured to the mounting ledge 15. The upper bow arm 3082 includes a relatively wide section that tapers to a relatively short, narrow section 3085. Similarly, the lower bow arm 3086 is constructed as an elongate, flat beam having one end secured to the bottom of the short section 14. The lower bow arm 3086 includes a relatively wide section that tapers to a relatively short, narrow section 3089.

In contrast to the flexing assembly 100, the flexing assembly 3100 does not include an upper pulley wheel in the upper bow arm 3082, which produces a weapon simpler in function, reduced costs, ease of manufacture, and lighter in weight due, in part, to fewer components. As shown, the flexing assembly 3100 includes a trunnion 3102 rotatably mounted near the distal end of the upper narrow section 3085 and a cam pulley assembly 3110 rotatably mounted to the lower narrow section 3089. The cam pulley assembly 3110 includes a rotatable shaft 3112, a pair of inner pulley wheels or rollers 3114 and a pair of outer pulley wheels 3116.

The flexing assembly 3100 is also provided with a pair of first flex cables 3106. Each first flex cable 3106 is anchored at one end to an anchor stub 3102*a* of the trunnion 3102, protruding laterally from the sides of the upper narrow section 3085. The remainder trains downward towards the lower, inner pulley wheels 3114, where the opposite end of the respective first flex cable 3106 anchors thereon. A second flex cable 3108 has each end anchored to respective outer pulley wheels 3116 of the cam pulley assembly 3110. The second flex cable 3108 extends from one outer pulley wheel 3116 and trains around the projectile stirrup carriage 3120 to the other outer pulley wheel 3116.

The interaction between the flex cables and the pulley wheels flexes the bow arms 3082 towards each other to cock the bow assembly 3080. During the above-described cocking operation, forced movement of the stirrup carriage 3120 towards the proximal or butt end of the projectile launcher 3000 rotates the outer pulley wheels 3116 (clockwise in the view shown in FIG. 14) through the connection with the second flex cable 3108. This, in turn, tensions the first flex cables 3106 by concurrent rotation of the inner pulley wheels 3114, which forces the upper bow arm 3082 and the lower bow arm 3086 to flex toward each other. A plurality of side idler guide rollers 3133, 3135 are provided to ensure that only a portion of the second flex cable 3108 deflects between the longitudinal ends of the rail system 3030 by confining the second flex cable 3108 between the guide rollers 3133, 3135.

It is contemplated that other arrangements of the above configuration can be provided which further reduces the number of parts and ease manufacture. For example, the trunnion 3102 can be removed entirely, and in place, a groove can be formed on the narrow section 3085 of the upper bow arm 3082. A single first flex cable 3106 can be trained around the groove and each end of the single first flex cable 3106 can be anchored to the respective inner pulley wheels 3114.

The elimination of the upper pulley wheel on the upper bow arm 3082 simplifies the cocking operation by eliminating balancing of rotation profiles between spaced upper and lower pulley mechanisms. Instead, the first flex cables 3106 are more directly connected to the upper bow arm 3082 via the trunnion 3102. As mentioned previously, dynamic balancing of forces must be maintained as much as possible between the arms 3082, 3086 in order to prevent potential deviations in the aim line. The elimination of the upper pulley wheel may impact the center of mass of the upper bow arm 3082 to a degree, i.e. the aggregate center of mass of the upper bow arm 3082 may be substantially less than the lower bow arm 3086. However, various adjustments can be made to the shape and material composition of the arms and to the placement of attached components to ensure both arms are in balance. An exemplary balancing adjustment can be made by attaching a weighted end 3081 to the end of the upper bow arm 3082. In all other respects, the projectile launcher 3000 functions in substantially the same manner as the projectile launcher 10.

Figure 15:
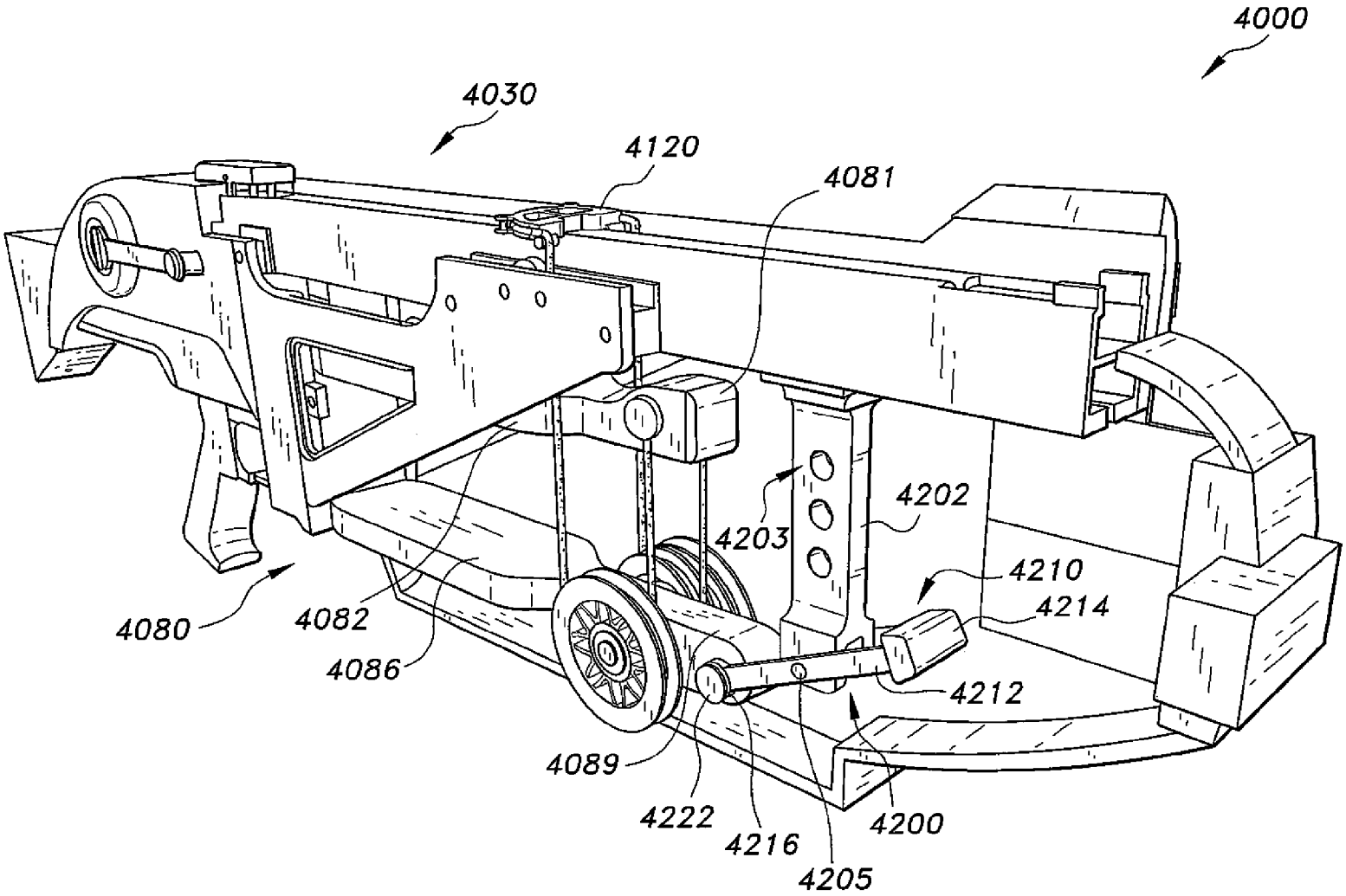
FIG. 15 is a perspective view of another alternative embodiment of a projectile launcher according to the present invention, shown with the side housing removed.
Figure 16:
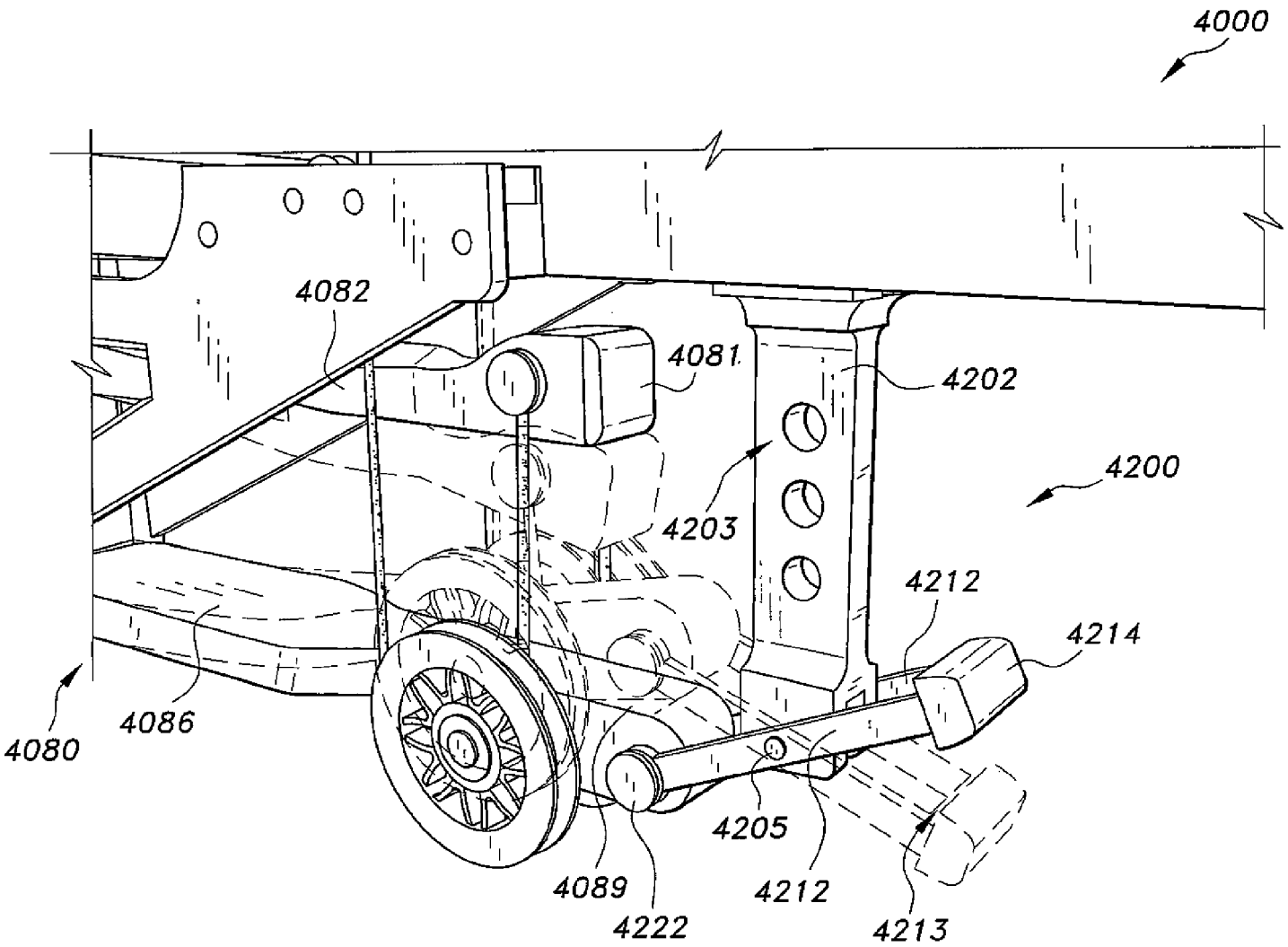
FIG. 16 is a partial perspective view of the embodiment of FIG. 15, showing the cocked and uncocked positions thereof.
Figure 17:
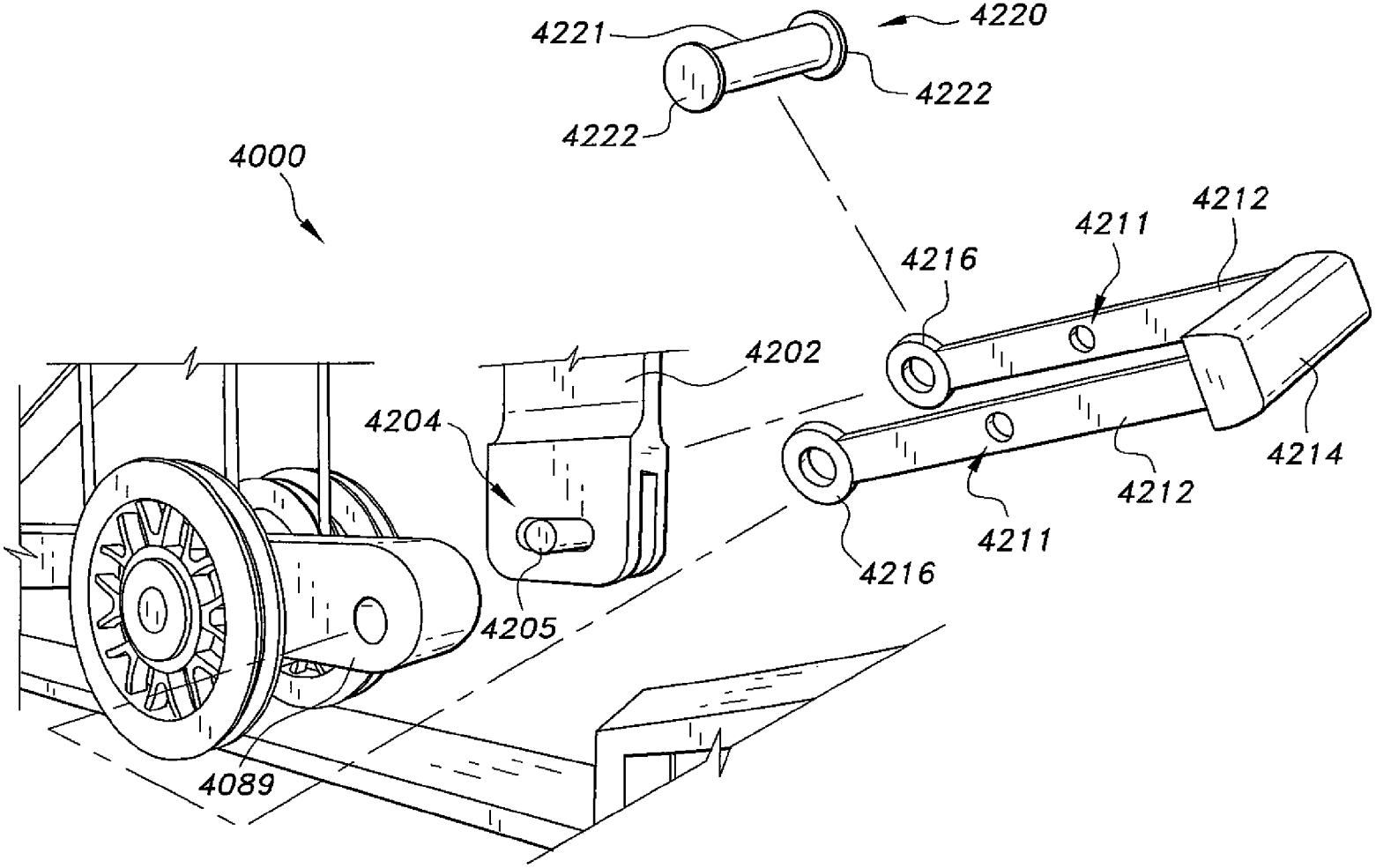
FIG. 17 is a partially exploded partial perspective view of the pivotal counterweight system of the embodiment of FIG. 15.

Another embodiment of a projectile launcher is shown in FIGS. 15-17. Initially, it is noted that the following description and corresponding reference numbers will be primarily focused on features different from the previous embodiments for clarity and brevity. In this embodiment, the projectile launcher 4000 includes counterweight features to assist in dynamically balancing the bow assembly.

As best shown in FIGS. 15-17, the projectile launcher 4000 is configured and functions substantially the same as the previously described projectile launcher 3000. In that regard, the projectile launcher 4000 includes a rail system 4030, a projectile stirrup carriage 4120 slidably attached to the rail system 4030, and a bow assembly 4080 disposed below the rail system 4030 and operatively connected to the stirrup carriage 4120, the bow assembly 4080 selectively storing the potential energy and then releasing the energy in order to provide the kinetic energy for firing a projectile supported on the stirrup carriage 4120. The projectile launcher 4000 is substantially the same in construction and function as the projectile launcher 3000, and most details common to both are not discussed unless otherwise described below or indicated by similar reference numbers.

The projectile launcher 4000 shows a couple of examples that achieve dynamic balance between the upper bow arm 4082 and the lower bow arm 4086. One of the examples includes attaching a weighted end 4081 to the distal end of the upper bow arm 4082. The weighted end 4081 can also be referred to as a first weighted end 4081. The other example includes a pivotal counterweight assembly 4200 operatively connected to the lower bow arm 4086.

As best shown in FIG. 17, the counterweight assembly 4200 includes a mounting stem 4202 in front of the bow assembly 4080. The mounting stem 4202 is constructed as an elongate, relatively thin bar depending from underneath the rail system 4030. One end or upper end of the mounting stem 4202 can be fixed to or detachably mounted on the rail system 4030. At least one hole or cutout 4203 is formed in the mounting stem 4202 in order to minimize weight of the projectile launcher 4000. The opposite or lower end of the mounting stem 4202 includes an elongate slot 4204 and a pivot pin 4205 insertably mounted therein. The slot 4204 is desirably elongate in order to compensate for the compound movement of the pivot pin 4205 during use, which will be further described below.

A swing arm or rocker arm 4210 is pivotally mounted to the pivot pin 4205 by a rocker mounting bracket 4213. The rocker mounting bracket 4213 can be a substantially U-shaped bracket having a pair of elongate members or legs 4212 that straddle the sides of the lower end of the mounting stem 4202. Each elongate member 4212 includes a pivot hole 4211 formed thereon for pivotally attaching a corresponding elongate member 4212 to a respective end of the pivot pin 4205. One end of each elongate member 4212 is also provided with an annular pivot bracket 4216 to pivotally attach the elongate members 4212 onto the distal end of the lower bow arm 4086. The other end of the elongate members 4212 is connected to a counterweight 4214.

In order to attach the elongate members 4212 onto the lower bow arm 4086, the distal end of the lower bow arm 4086 is provided with an elongate counterweight trunnion 4220. The counterweight trunnion 4220 includes an elongate shaft, rod or pin 4221 supporting at least a pair of flat washer heads or flanges 4222 at opposite ends of the shaft 4221. The length of the shaft 4221 is preferably longer than the width of the lower narrow section 4089 so that when assembled, room or space exists between each flange 4222 and the respective, lateral side of the lower narrow section 4089 to accommodate mounting the annular pivot bracket 4216 of each elongate member 4212.

In the above construction, one end of the elongate members 4212 is pivotally mounted to the lower bow arm 4086 via the counterweight trunnion 4220, while the opposite end carries and supports the counterweight 4214. Due to the pivotal connection to the mounting stem 4202, the counterweight assembly 4200 moves in a "seesaw" manner during use with the counterweight 4214, swinging freely.

The movement of the counterweight assembly 4200 is dependent upon the movement of the bow arm to which the counterweight assembly 4200 is attached. In this instance, the counterweight assembly 4200 is pivotally connected to the lower bow arm 4086. During the cocking process, the distal end of the lower bow arm 4086 flexes in an effective, spiraling arc. Such motion includes angular and translational components. A fixed pivot on the mounting stem 4202 would prevent a corresponding movement of the counterweight assembly 4200 because the movement thereof would be limited to rotation. Instead, the elongate slot 4204 provides space for the pivot pin 4205 to adjustably translate to compensate for the translation component of the bow arm flex, while maintaining pivoting movement of the rocker bracket 4213.

In use, the counterweight 4214 compensates for differences between the masses and bow strokes, i.e. the flexure characteristics of the respective bow arms inclusive of the effects of other components thereon, of the upper bow arm 4082 and the lower bow arm 4086.

As mentioned previously, dynamic balance must be maintained to insure accuracy of the projectile launcher 4000 as noted in the other previously mentioned embodiments. The counterweight 4214 provides the necessary opposing mass so that substantially the same equal but opposite center of gravity will be maintained and be vertically invariant between the upper and lower bow arms 4082, 4086 throughout the process of the upper and lower bow arms 4082, 4086 being cocked and released. Generally, such dynamic balance is achieved when the sum of the products of mass and stroke for each component of the upper bow arm 4082 equates to that of the lower bow arm 4086, where stroke is the vertical distance traveled by that component or part during cocking and firing. The product of mass and stroke being mathematically representative of the contribution to the vertical shift in center of gravity. Notably, the movement of the counterweight 4214 parallels the movement of the upper bow arm 4082 when the counterweight assembly 4200 is attached to the lower bow arm 4086, i.e., when the upper bow arm 4082 flexes downward, the counterweight 4214 pivots downward in response to the upward flex of the lower bow arm 4086. The counterweight assembly 4200 can also be attached to the upper bow arm 4082 with corresponding adjustments to the mounting stem 4202, if necessary, and the movement of counterweight 4214 would parallel movement of the lower bow arm 4086 instead. In either case, the parallel movement of the counterweight 4214 demonstrates how the counterweight 4214 adds a mass-stroke product that offsets the greater mass-stroke product of the heavier bow arm during movement thereof in order to achieve overall dynamic balance between the upper and lower bow arms 4082, 4086. Additionally, it should be noted that the counterweight assembly 4200 can be combined with the weighted end 4081 to achieve similar results.

Figures 18A, 18B:
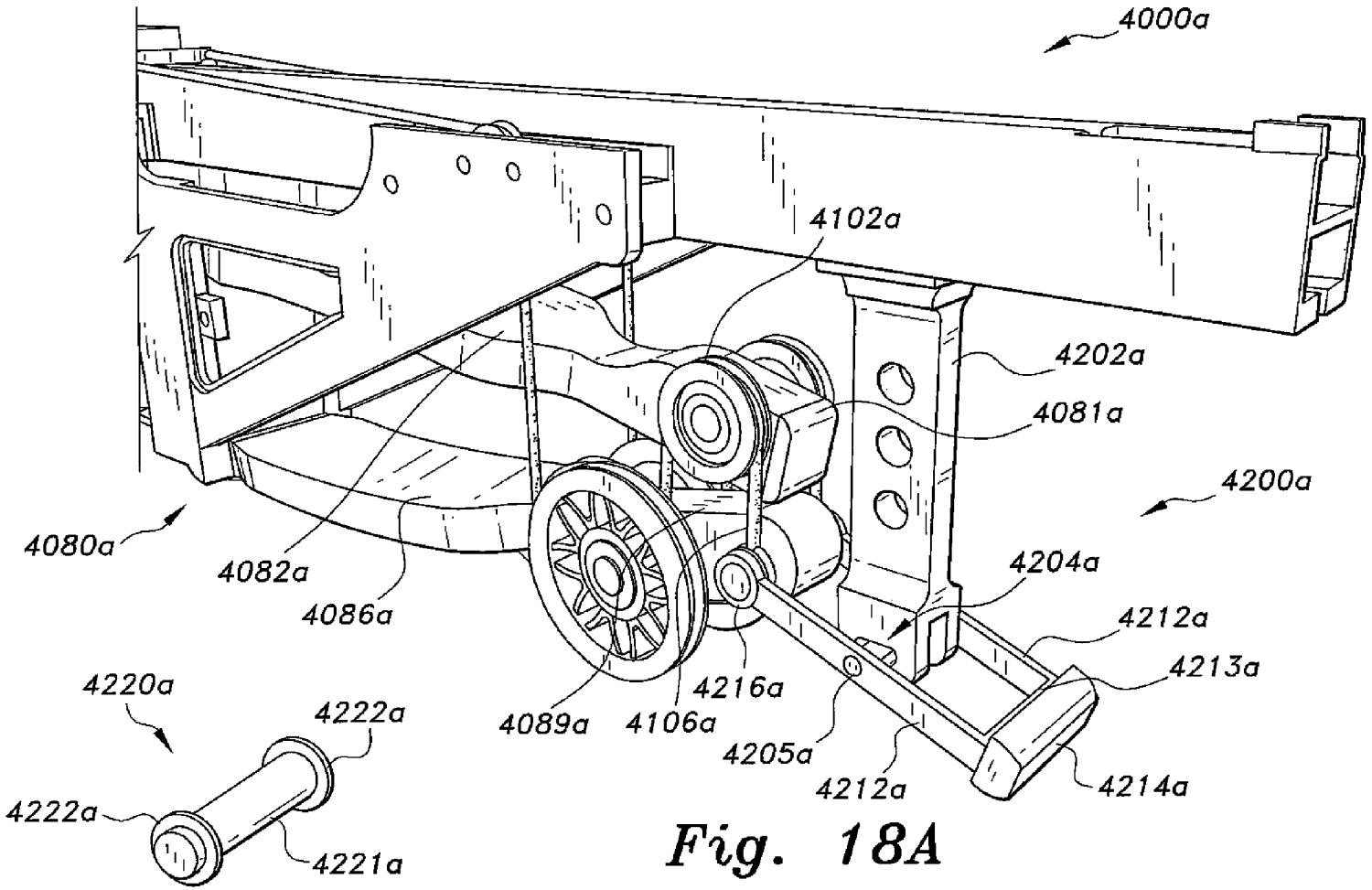
FIG. 18A is a partial perspective view of a projectile launcher according to the present invention, shown with parts removed to show the counterweight system used in the bow mechanism of FIG. 8.
FIG. 18B is a perspective view of a trunnion used in the projectile launcher shown in FIG. 18A.

In another embodiment shown in FIGS. 18A and 18B, the projectile launcher 4000*a* employs a counterweight assembly 4200*a* to a bow assembly 4080*a* having an upper pulley wheel 4102*a* mounted to the upper bow arm 4082*a*. The projectile launcher 4000*a* is substantially the same as the projectile launcher 10 in operation and function. However, the counterweight assembly 4200*a* has been modified to accommodate the upper pulley wheel 4102*a* and the first flex cable 4106*a* thereon. Due to the similarities between the projectile launcher 4000*a*, the projectile launcher 4000, and the projectile launcher 10, similar reference numbers have been used for relevant features followed by the designator "a". Although some reference numbers in the drawings may not be explicitly mentioned herein, it is to be understood that those features are referenced by the same reference scheme employed in the description of the previous embodiments.

In this embodiment, the projectile launcher 4000*a* includes the counterweight assembly 4200*a* mounted in front of the bow assembly 4080*a*. The counterweight assembly 4200*a* includes a mounting stem 4202*a*, a rocker arm 4213*a* pivotally mounted to the mounting stem 4202*a* via a pivot pin 4205*a* slidably mounted in an elongate slot 4204*a*, at least one pair of elongate members 4212*a* having an annular pivot bracket 4216*a* at one end pivotally attached to the lower bow arm 4086*a*, and a counterweight 4214*a* attached to the opposite end of the elongate members 4212*a*. As shown, this is substantially the same configuration as that of the previously described counterweight assembly 4200.

Due to the arrangement of the first flex cable 4106*a* and the connection thereof to the upper pulley wheel 4102*a* required to flex the upper bow arm 4082*a*, the counterweight assembly 4200*a* is provided with a counterweight trunnion 4220*a* that can accommodate both the mounting of the annular pivot bracket 4216*a* and anchoring one end of each first flex cable 4106*a*. In that regard, the counterweight trunnion 4220*a* can be constructed as an elongate shaft 4221*a* with a length greater than the width of the lower narrow section 4089*a*. At least one flange 4222*a* is mounted near opposite ends of the shaft 4221*a*. Each flange 4222*a* is spaced from the edge of the respective end inward towards the center of the shaft 4221*a*. The spacing from the edge provides room for pivotally attaching a respective annular pivot bracket 4216*a* thereon on the outer facing side of the respective flange 4222*a*. Additionally, the length of the shaft 4221*a* is preferably long enough to accommodate anchoring of one end of each respective first flex cable 4106*a* on the other, inner facing side of the respective flange 4222*a*. In substantially all other respects, the projectile launcher 4000*a* functions substantially the same as the projectile launcher 4000, at least with respect to the dynamic counterbalancing function, and as the projectile launcher 10.

As described, the above projectile launchers 4000 and 4000*a* incorporate at least two different methods or systems for dynamically balancing the upper and lower bow arms during cocking and firing, e.g., a weighted end or a counterweight assembly. These methods or systems can be used independently, interchangeably, or in combination based upon the balancing needs of a particular, user-defined bow assembly configuration.

Other embodiments of a projectile launcher are shown in FIGS. 19-23. In these embodiments, the projectile launchers utilize a variant propulsion system to the previously described bow assemblies in order to propel a projectile.

Figure 19:
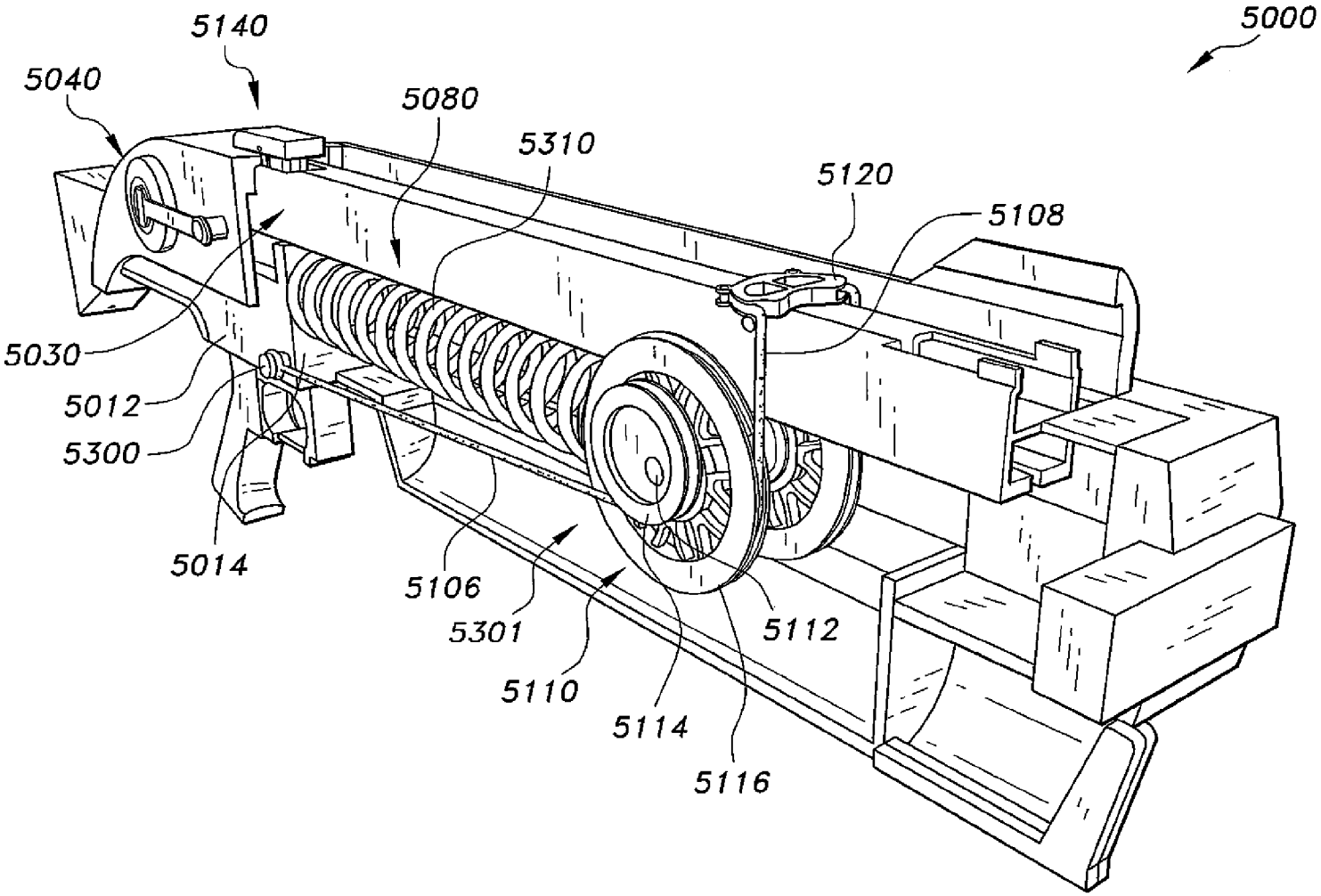
FIG. 19 is a perspective view of another alternative embodiment of a projectile launcher according to the present invention.
Figure 20:
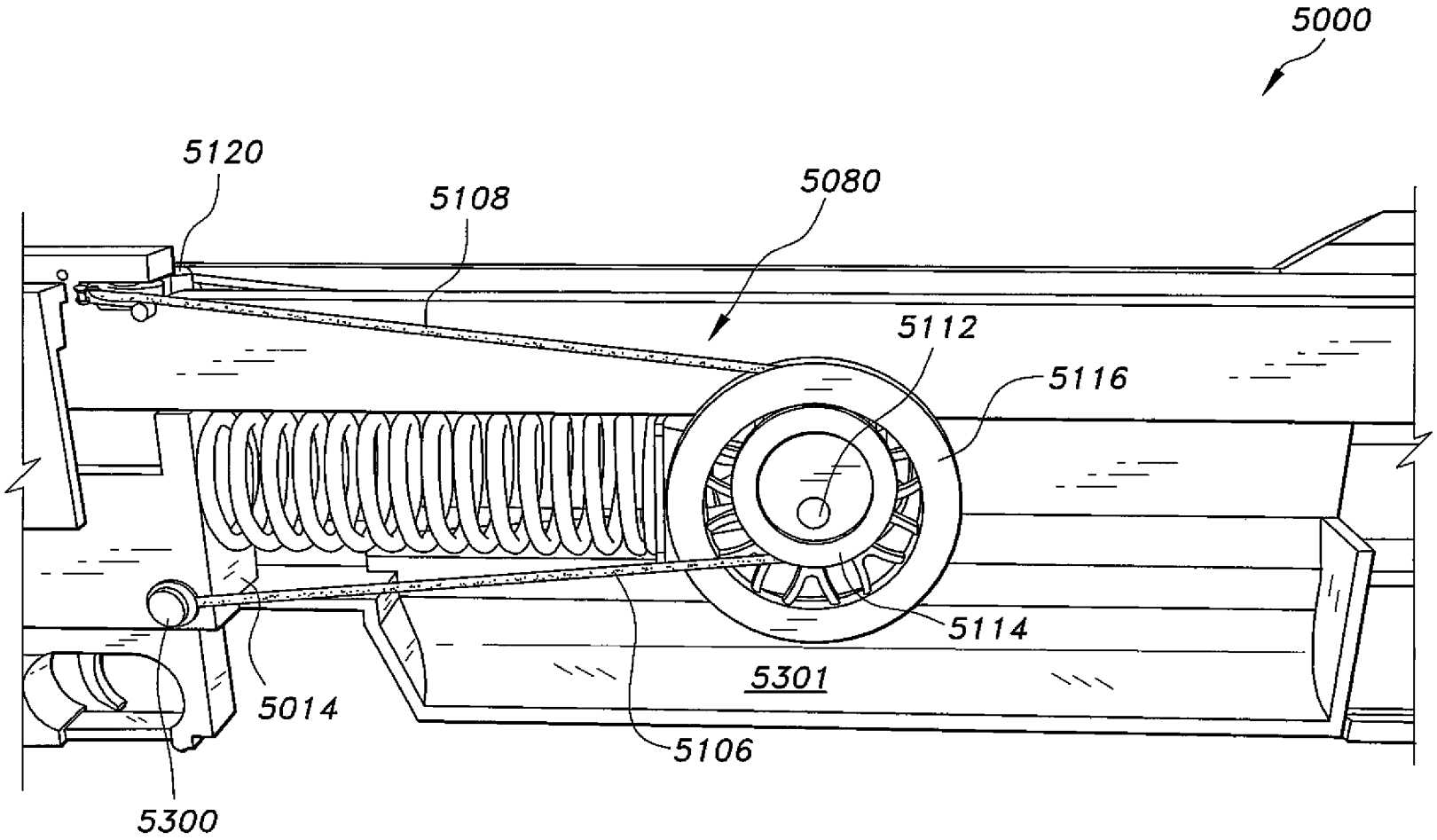
FIG. 20 is a partial perspective view of the projectile launcher of FIG. 19, shown in the cocked position.

As best shown in FIGS. 19 and 20, the projectile launcher 5000 includes a rail system 5030, a projectile stirrup carriage 5120 slidably attached to the rail system 5030, a trigger system 5140 to selectively hold and release the stirrup carriage 5120, and a cocking mechanism 5040. These features are substantially the same and function as those of the previously described projectile launchers, e.g., projectile launcher 10.

Unlike the previous embodiments, the projectile launcher 5000 includes a biased propulsion system 5080 disposed below the rail system 5030. The biased propulsion system 5080 includes an elongate compression or coil spring 5310 and a freely movable cam pulley carriage 5330 operatively connected thereto. Selective compression of the compression spring 5310 during cocking of the projectile launcher 5000 stores potential energy, and upon release, transforms the potential energy into kinetic energy to propel a projectile attached to the stirrup carriage 5120.

As best shown in FIG. 19, the compression spring 5310 extends a substantial length of the rail system 5030 in the normal, uncocked state. Each opposite end of the compression spring 5310 has been formed or ground to have a flat, planar surface 5312. When assembled and during operation, the flat surfaces 5312 at the ends prevent potential rolling or rocking movement of the compression spring 5310 with respect to the surface each end abuts. Any such rolling movement can potentially displace the compression spring 5310 out of proper alignment for transmitting the motive force, which can ultimately affect the aim and trajectory of the projectile being loosed.

The front side of a riser base 5012 presents a substantially flat, planar surface 5014. The planar surface 5014 supports abutment of one end of the compression spring 5310 via the flat surface 5312 thereon. The two respective flat surfaces provide a stable, operative connection between the riser base 5012 and the compression spring 5310.

Figure 21:
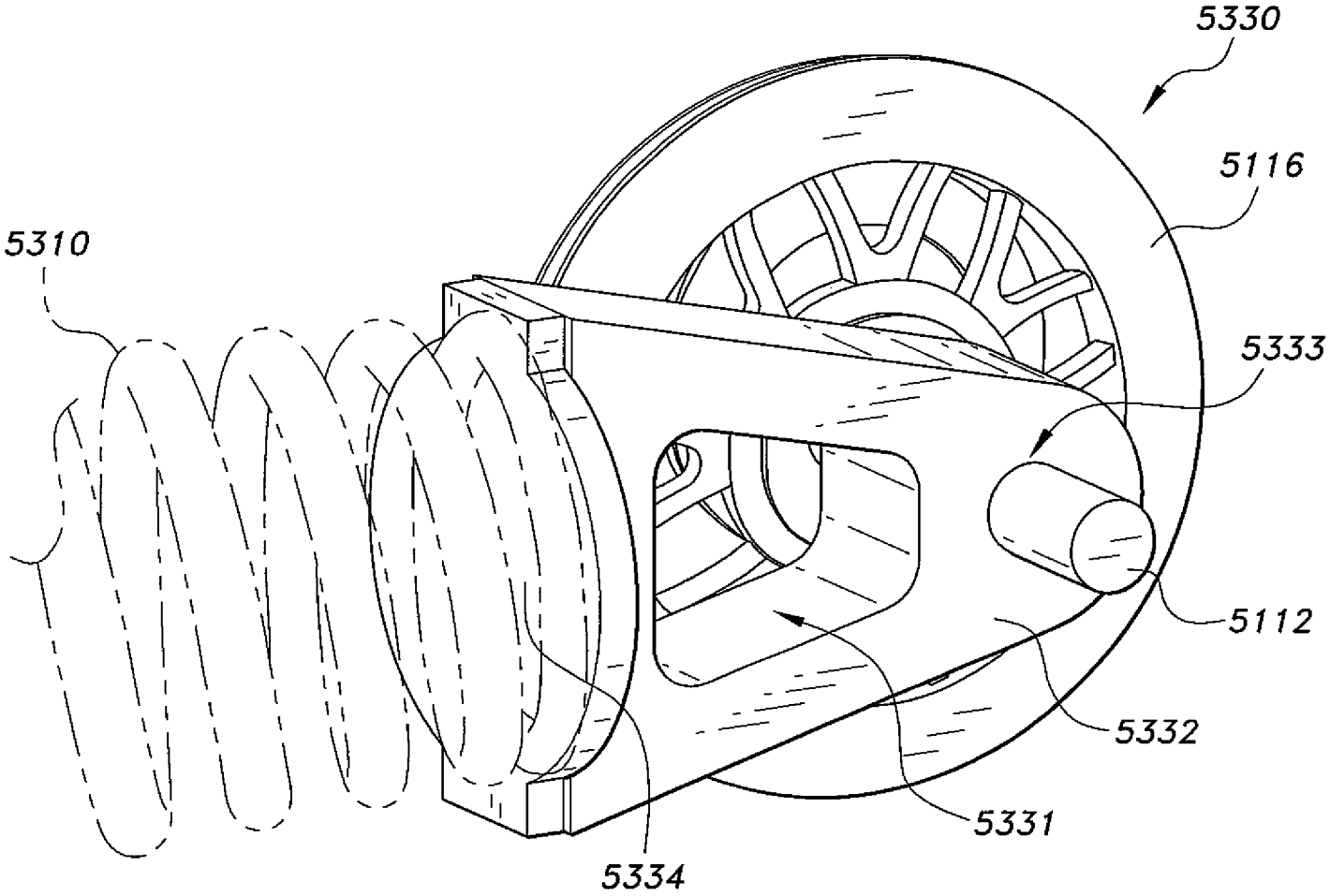
FIG. 21 is a perspective view of a pulley bracket used in the biased power system of the projectile launcher of FIG. 19, the spring being shown in hidden lines and one of the pulleys removed for clarity.
Figure 22:
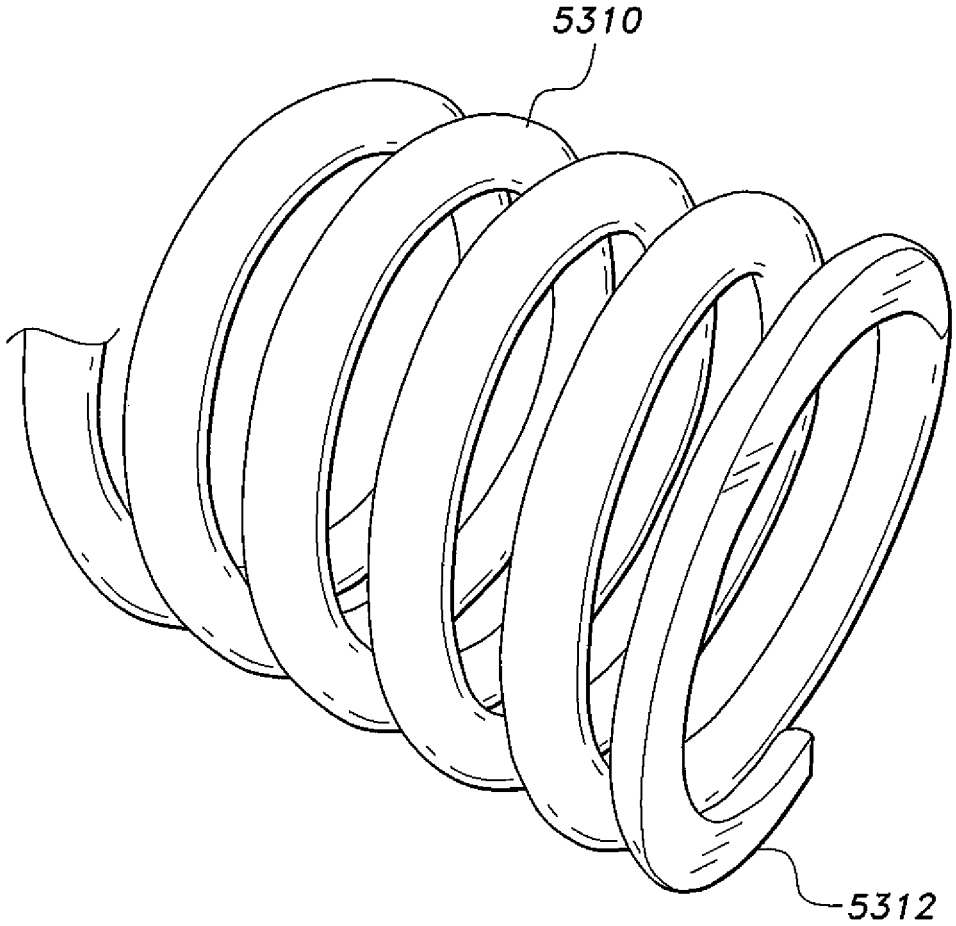
FIG. 22 is a perspective view of one end of a compression spring in the biased propulsion system for the projectile launcher of FIG. 19

The opposite end of the compression spring 5310 is operatively connected to the cam pulley carriage 5330. As best shown in FIG. 21, the cam pulley carriage 5330 includes a carriage body 5332 and a cam pulley assembly 5110 mounted thereon. The carriage body 5332 is preferably a substantially wedge-shaped member and includes a throughbore 5333 near the front for selective insertion of a rotatable support shaft, rod or axle 5112. The substantial wedge-shape of the carriage body 5332 provides the body 5332 with a lightweight and aerodynamic profile, which assists in minimizing potential drag and any degradation of motive force being transmitted when the compression spring 5310 is released from the compressed, cocked position. Although the travel distance may be relatively short in terms of distances in general, the acceleration of the carriage body 5332 is very rapid when the compression spring 5310 pushes against the carriage body 5332 upon release from the cocked position. That type of acceleration in such a relatively short time period can cause drag, depending on the shape passing through the air. In the same vein, the carriage body 5332 is desirably constructed to include at least one hole, aperture, or cutout 5331 as a means of minimizing mass and weight. Minimizing the mass of the carriage body 5332 translates to maximal kinetic energy output to the projectile B, since less energy would be required to move that mass. The shape of the carriage body 5332 also contributes to producing a lightweight component, the wedge shape being one of many lightweight shapes for the carriage body 5332. However, it is to be understood that the carriage body 5332 can be constructed with different shapes and/or solid configurations. Other methods can be employed to maximize kinetic output by compensating for a given mass and/or reducing mass as much as possible. Some examples include, but are not limited to, adjusting the strength or stiffness of the compression spring 5310, the material selection of the cam pulley carriage 5330, a lattice construction of the carriage body 5332, and the like.

As shown in the drawings, the tapered front end of the carriage body 5332 includes the throughbore 5333, while the back end is provided with a substantially flat surface 5334. The flat surface 5312 of the opposite end of the compression spring 5310 is in contact with the back flat surface 5334 when assembled and during operation. As with the flat surface 5014, the surface-to-surface contact between these flat planar surfaces provides a stable contact for pushing the carriage body 5332, thereby ensuring that the carriage body 5332 travels in the desired direction with maximal transfer of energy.

The cam pulley assembly 5110 includes the rotatable shaft 5112 mounted through the throughbore 5333, a pair of inner pulley wheels or rollers 5116 and a pair of outer pulley wheels or rollers 5114. The inner pulley wheels 5116 are rigidly attached to the shaft 5112, and each outer pulley wheel 5114 is coaxially and rigidly mounted to the shaft 5112 at preferably an offset or eccentric axis adjacent to a respective inner pulley wheel 5116. When assembled, the inner pulley wheels 5116 reside on the sides of the carriage body 5332. Each inner pulley wheel 5116 has a given, preselected diameter. The diameter of the outer pulley wheels 5114 is preferably smaller than the inner pulley wheels 5116. Due to the eccentric axial mounting of the outer pulley wheels 5114, rotation of the inner pulley wheels 5116 causes a corresponding cam rotation of the outer pulley wheels 5114. The specific construction of the inner and outer pulley wheels 5116, 5114 can be substantially the same as the inner and outer pulley wheels 114, 116 in the previously described projectile launcher 10. In an embodiment to the above, both the inner and outer pulley wheels 5116, 5114 can be coaxially aligned instead of offset. Such an arrangement can minimize small cyclical vertical shifting of the center of mass of the cam pulley assembly 5110 during firing which can further improve aim accuracy.

The transfer of motive force from the compression spring 5310 is facilitated by flex cable connections. As best shown in FIGS. 19 and 20, the biased propulsion system 5080 includes a pair of first flex cables 5106. Each first flex cable 5106 is anchored at one end to an anchor stub 5300 disposed on the sides of the riser base 5012 below the horizontal line of extension of the compression spring 5310. The remainder of each first flex cable 5106 is wound around a respective outer pulley wheel 5114, and the opposite end of each first flex cable 5106 is anchored to the respective outer pulley wheel 5114. A second flex cable 5108 has each end anchored to respective inner pulley wheels 5116 of the cam pulley assembly 5110. The second flex cable 5108 extends from one inner pulley wheel 5116 and trains around the projectile stirrup carriage 5120 to the other inner pulley wheel 5116. The interaction between the first and second flex cables 5106, 5108 and their effect on the cam pulley assembly 5110 facilitates selective compression of the compression spring 5310 and subsequent, controlled release of kinetic energy upon release of compression.

In use, the compression spring 5310 is normally in a relatively uncompressed state, as shown in FIG. 19, which is exemplary of the uncocked position. Depending on the length of the flex cables 5106, 5108, a small amount of compression may exist causing the carriage body 5332 to press against the compression spring 5310. This is a desirable condition, since it would insure that the compression spring 5310 will remain in the desired position within the body of the projectile launcher 5000 during operation. Moreover, it is similar in function to a strung bow in which the string is kept in constant tension. The lengths of the first flex cable 5106 and the second flex cable 5108 can also be adjustably fixed to provide the desired amount of tension, and thus pre-compression of the compression spring 5302.

When cocking the projectile launcher 5000, the cocking mechanism 5040 pushes the projectile stirrup carriage 5120 towards the trigger system 5140. This forces the second flex cable 5108 to pull away and unwind from the inner pulley wheels 5116. At the same time, the unwinding rotation (i.e., counterclockwise in FIG. 19) of the inner pulley wheels 5116 forces the outer pulley wheels 5114 to rotate in the same direction, pulling in and winding the first flex cables 5106. The winding and unwinding actions of the flex cables 5106, 5108, through their connection to the carriage body 5332, push the carriage body 5332 towards the back of the projectile launcher 5000 to thereby compress the compression spring 5310 until the stirrup carriage 5120 is at the cocked position.

Turning to FIG. 20, which shows the cocked position or state of the projectile launcher 5000, it can be seen that the angular orientation of the first flex cable 5106 and the angular orientation of the second flex cable 5108 with respect to the virtual line of extension of the compression spring 5310 are not equal with respect to each other. Additionally, supported forces of the first flex cable 5106 and the supported forces of the second flex cable 5108 are not equal, with the first flex cable 5106 supporting more force. However, due to the generally lesser angular orientation of the first flex cable 5106 with the outer pulley wheels 5114 compared to the second flex cable 5108 with the inner pulley wheels 5116, the net vertical forces are kept in balance, i.e., neither cable is exerting a greater net vertical force than the other that would tend to bend the compression spring 5310 vertically either up or down. The anchor stub 5300 is disposed below the horizontal line of extension of the compression spring 5310, which assists in maintaining the desired angular orientation of the first flex cable 5106. This type of balance is preferably maintained in order to insure that the force exerted by the spring 5310, when loosed or fired, remains horizontally level. This is another type of dynamic balance for use with the propulsion system 5080.

After the projectile launcher 5000 fires or loose the projectile B (or dry fires), the trained engagement of the first and second flex cables 5106, 5108 with their respective outer and inner pulley wheels 5114, 5116 insures rapid deceleration of the stirrup carriage 5120 when the stirrup carriage 5120 travels past the normal uncocked position along the rail system 5030. As the momentum of the cam pulley carriage 5330 forces the stirrup carriage 5120 towards the distal end of the rail system 5030 when fired, the inner pulleys 5116 wind the second flex cable 5108 thereon. Past the normal uncocked position, continuous winding by the inner pulley wheels 5116 pulls on the stirrup carriage 5120 to provide a braking force, the braking force increasing the further the stirrup carriage 5120 and/or the cam pulley carriage 5330 travels past the uncocked position. The braking force is mainly caused by the stirrup carriage 5120 being pulled down onto the rail system 5030 as the length of the second flex cable 5108 shortens due to the continued winding of the same around the inner pulley wheels 5116. Additionally, continued motion of the stirrup carriage 5120 past the normal uncocked position results in the first flex cables 5106 unwinding and rewinding which causes recompression of the compression spring 5310 similar to the cocking operation described above. These two effects work to arrest the motion of both the cam pulley carriage 5330 and the stirrup carriage 5120.

Thus, the combined braking facilitated by the first flex cables 5106 and the second flex cable 5108 through their respective winding and unwinding actions on the inner pulley wheels 5116 and outer pulley wheels 5114 rapidly decelerates the stirrup carriage 5120 and the cam pulley carriage 5330. Some oscillations can occur, but the oscillations are minimal.

Figure 23:
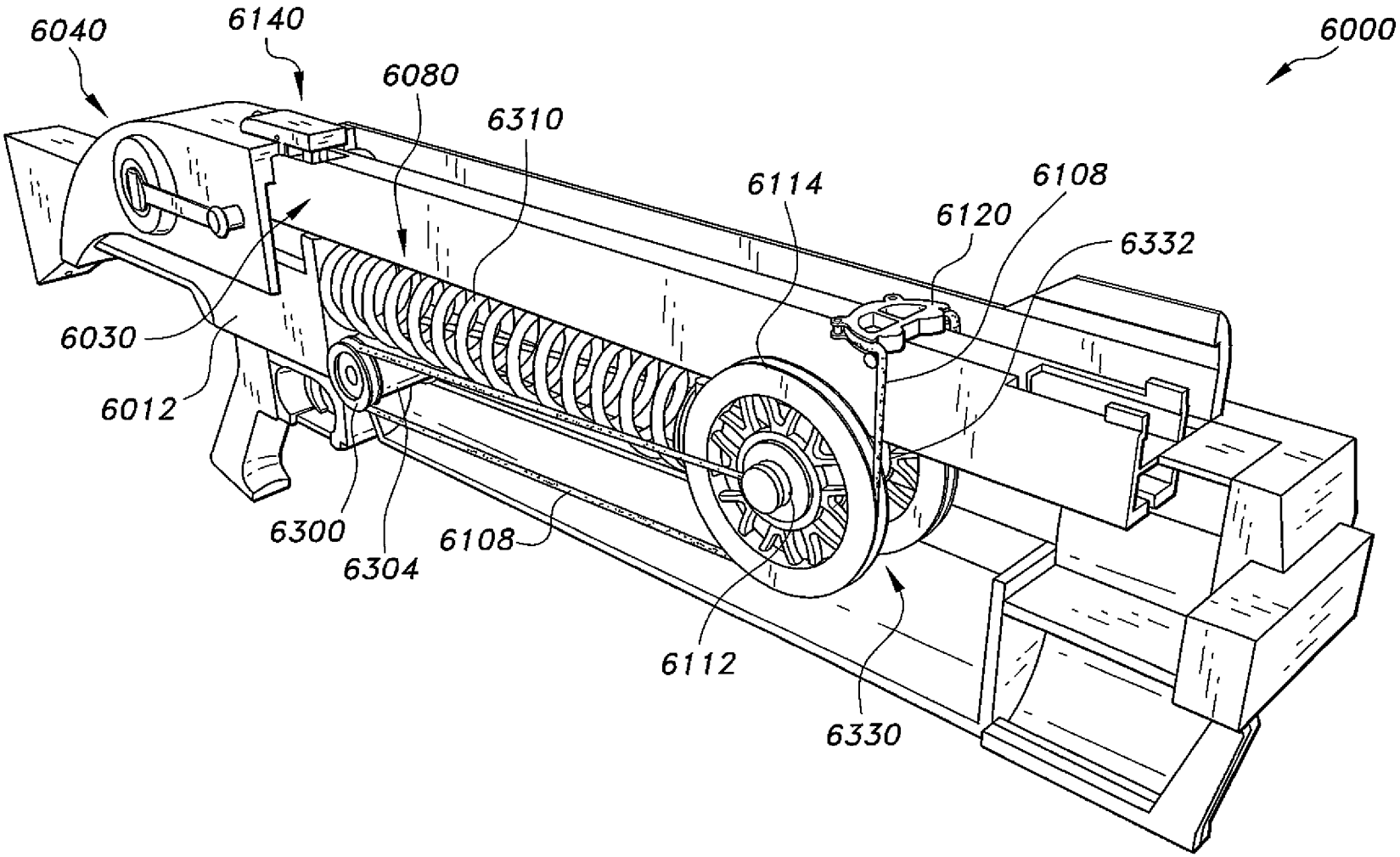
FIG. 23 is a perspective view of another alternative embodiment of a projectile launcher according to the present invention.

The projectile launcher 6000 shown in FIG. 23 is a further variation of the projectile launcher 5000. In this embodiment, the projectile launcher 6000 includes a rail system 6030, a projectile stirrup carriage 6120 slidably attached to a rail system 6030, a trigger system 6140 to selectively hold and release the stirrup carriage 6120, and a cocking mechanism 6040. These features are substantially the same as those of the previously described projectile launchers, e.g., projectile launcher 10.

The projectile launcher 6000 also includes a biased propulsion system 6080 disposed below the rail system 6030. The biased propulsion system 6080 includes an elongate coil or compression spring 6310 and a freely movable pulley carriage 6330 operatively connected thereto. Selective compression of the compression spring 6310 during cocking of the projectile launcher 6000 stores potential energy, and upon release, transforms the potential energy into kinetic energy to propel a projectile attached to the stirrup carriage 6120.

Both the compression spring 6310 and the pulley carriage 6330 are substantially the same construction as the previously described compression spring 5310 and cam pulley carriage 5330. However, the pulley carriage 6330 does not include cam pulleys. Instead, the pulley carriage 6330 rotatably supports a pair of pulley wheels 6114 mounted to a trunnion or shaft 6112. Additionally a mounting block or support block 6304 is provided in front of the riser 6012 and underneath the compression spring 6310. A pair of idler pulleys 6300 is rotatably mounted to the mounting block 6304.

In order to compress the compression spring 6310, the biased propulsion system 6080 also includes a flex cable 6108 operatively connected to the pulley wheels 6114, the idler pulleys 6300 and the stirrup carriage 6120. From one side of projectile launcher 6000, one end of the flex cable 6108 is anchored to one end of the shaft 6112 and trained around one of the idler pulleys 6300. The flex cable 6108 is looped back from the one idler pulley 6300 and trained around one of the pulley wheels 6114 to be trained around the stirrup carriage 6120. The flex cable 6108 continues to the other side of the projectile launcher 6000 and trains around the other pulley wheel 6114 and the other idler pulley 6300, and is then anchored to the opposite end of the shaft 6112. In an embodiment, the ends of the flex cable 6108 can be anchored to a separate trunnion disposed near the back end of the pulley carriage 6330. Thus, the flex cable 6108 forms a continuous loop interconnecting the pulley wheels 6114, the idler pulleys 6300, and the stirrup carriage 6120. The flex cable 6108 is preferably of a fixed length that places tension on the flex cable 6108 when anchored to the ends of the shaft 6112. This also compresses the compression spring 6310 to a degree that insures constant contact between the compression spring 6310 and the pulley carriage 6330.

In use, as the stirrup carriage 6120 is pushed towards the trigger system 6140 by the cocking mechanism 6040, the stirrup carriage 6120 pulls on the flex cable 6108. The engagement of the flex cable 6108 with the pulley wheels 6114 causes the pulley wheels 6114 to rotate (counterclockwise in the view shown in FIG. 23), and due to the ends of the flex cable 6108 being anchored to opposite ends of the shaft 6112, also pulls the pulley carriage 6330 in the same direction as the stirrup carriage 6120, thereby compressing the compression spring 6310. The compression continues until the stirrup carriage 6120 is latched in the cocked position by the trigger system 6140.

When the projectile launcher 6000 is fired or loosed, the stirrup carriage 6120 rapidly traverses the rail system 6030 due to the pulley carriage 6330 being pushed by the compression spring 6310. As the stirrup carriage 6120 travels past the normal uncooked position, the stirrup carriage 6120 rapidly decelerates in substantially the same manner as with the projectile launcher 5000. In this instance, the fixed length of the flex cable 6108 places a constantly increasing downward force on the stirrup carriage 6120 the further the stirrup carriage 6120 travels past the uncooked position.

The arrangement of the pulley wheels 6114, the idler pulleys 6300, and the flex cable 6108 trained thereon also provides a mechanical advantage in much the same manner as a "gun tackle" pulley system, except configured as a rove to advantage variant. In this instance, the flex cable 6108 is trained so that the flex cable 6108 is attached to the moving pulley wheels 6114 and the flex cable 6108 is pulled in substantially the same direction as the direction of compression, where the weight is construed as the force required to further compress the compression spring 6310 from a pre-compressed state. This arrangement provides about 3:1 mechanical advantage. Thus, the user needs to exert about one-third of the force via the cocking mechanism 6040 to facilitate compression of the compression spring 6310. That results in a powerful yet lightweight projectile launcher 6000. Moreover, since only a single pair of pulley wheels are included in the pulley carriage 6330, the construction of the projectile launcher 6000 is less complex and easier to assemble.

As with the projectile launcher 5000, the projectile launcher 6000 has been constructed so that the angular disposition of the flex cable 6108 extending between the stirrup carriage 6120 and the pulley wheels 6114 and the angular disposition of the flex cable 6108 between the idler pulley 6300 and the pulley wheels 6114 with respect to the horizontal are not equal when the stirrup carriage 6120 is in the cocked position. The angular disposition of the portions of the flex cable 6108 between the idler pulley 6300 and the pulley wheels 6114 is maintained by the location of the idler pulleys 6300. The different angular dispositions results in equal vertical component forces that balance out to ensure a linear horizontal stroke of the compression spring 6310 when fired. This is another type of dynamic balance mechanism for use with this propulsion system 6080.

It is to be understood that the projectile launcher 10, 1000, 2000, 3000, 4000, 5000, 6000 encompasses a variety of alternatives. For example, the projectile launcher 10, 1000, 2000, 3000, 4000, 5000, 6000 can be constructed from a variety of durable materials, such as wood, plastic, metal, composites and combinations thereof. Additionally, while the upper and lower rail sections 32, 34 have been shown to be separate but integral components, both can be constructed as a single, unitary structure. The rail sections 32, 34 can also be provided in various shapes, so long as they can support the cocking operation. The cocking pawl carriage can also be sized and shaped accordingly to accommodate differently shaped rail sections 32, 34. Alternative gearing arrangements can be constructed for transferring the rotating crank motion into corresponding winding and reeling motion in the cocking mechanism 40. For example, the transmission gear assembly 70 and bevel gear 67 can alternatively be replaced by a simple gear fixed to the crank 64 and used in combination with a ratchet mechanism. Furthermore, various moving parts can be provided with or constructed from friction-reducing material. As mentioned previously, the projectile launcher 10, 1000, 2000 is capable of firing various types of elongate projectiles. Other types of projectiles, such as pellets, balls, discs and the like, can also be used with appropriate modifications to the stirrup carriage and/or the rail system to accommodate the shape. Similar capabilities can be provided for the projectile launchers 3000, 4000, 5000, 6000.

It is to be understood that the present invention is not limited to the embodiments described above, but encompasses any and all embodiments within the scope of the following claims.

I claim:

1. A projectile launcher, comprising:

a riser base, the riser base having a top, a bottom, and a front;

a barrel assembly attached to the riser base, the barrel assembly having an elongate rail system adapted for placement of a projectile, the rail system having a top and a bottom;

a projectile stirrup carriage slidably engaged with the top of the rail system, the projectile stirrup carriage being adapted for supporting the back of the projectile for selective release thereof;

a cocking mechanism coupled to the rail system, the cocking mechanism having a cocking pawl carriage selectively engageable with the projectile stirrup carriage to cock the projectile stirrup carriage into a cocked position;

a propulsion system coupled to the riser base, the propulsion system storing potential energy during cocking of the projectile stirrup carriage into a cocked position, the propulsion system releasing the potential energy as kinetic energy accelerating the projectile stirrup carriage when the projectile stirrup carriage is released from the cocked position in order to fire the projectile;

a dynamic balancing mechanism coupled to the propulsion system, the dynamic balancing mechanism maintaining a substantially straight linear transfer of kinetic energy substantially parallel to the rail system during firing of the projectile;

a crank mechanism attached to the rail system, the crank mechanism selectively reciprocating the cocking carriage; and a trigger assembly attached to the riser base, the trigger assembly selectively catching and releasing the projectile stirrup carriage, wherein the propulsion system comprises an elongate compression spring disposed below the rail system, the compression spring extending in a horizontal line, the compression spring having a flat surface at opposite ends, one end of the compression spring abutting the front of the riser base;

a pulley carriage abutting the opposite end of the compression spring, the pulley carriage having a shaft at one end, at least one pulley wheel rotatably mounted on the shaft, and a flat surface at the other end of the pulley carriage, the flat surface of the pulley carriage abutting the opposite end of the compression spring; and at least one flex cable attached to the pulley carriage, the at least one flex cable being trained around the at least one pulley wheel and the projectile stirrup carriage;

wherein movement of the projectile stirrup carriage towards the cocked position pulls the at least one flex cable, thereby rotating the at least one pulley wheel and concurrently unwinding the at least one flex cable and moving the pulley carriage to compress the compression spring, wherein the dynamic balancing mechanism comprises a mounting block disposed below the horizontal line of extension of the compression spring and a pair of spaced idler pulleys rotatably mounted to the mounting block, each end of the at least one flex cable being anchored to the pulley carriage and the remainder of the at least one flex cable being trained around one of the idler pulleys and the at least one pulley wheel from one side of the projectile launcher to train around another of the at least one pulley wheel and the other idler pulley on the opposite side of the projectile launcher, portions of the at least one flex cable extending between the idler pulleys and the at least one pulley wheel at a first angular orientation with respect to the horizontal line of extension, portions of the at least one flex cable extending between the projectile stirrup carriage and the at least one pulley wheels at a second angular orientation different from the first angular orientation when the projectile stirrup carriage is in the cocked position, the portions of the at least one flex cable defining the first angular orientation exerting a combined vertical force component equal and opposite to the portions of the at least one flex cable defining the second angular orientation and therefore balanced to prevent the compression spring from deviating from the horizontal line of extension when released from the cocked position.

2. The projectile launcher according to claim 1, wherein said at least one pulley wheel comprises;

a pair of spaced inner pulley wheels rotatably mounted to said pulley carriage; and a pair of spaced outer pulley wheels mounted coaxially with the inner pulley wheels, the outer pulley wheels being smaller than the inner pulley wheels, said at least one flex cable comprising a pair of first flex cables and a second flex cable, each of the first flex cables having one end anchored at said riser base and the other end trained around the outer pulley wheels, the second flex cable having each end trained around a respective inner pulley wheel.

3. The projectile launcher according to claim 2, wherein said pair of spaced outer pulley wheels is mounted coaxially with the inner pulley wheels at an offset axis.

4. The projectile launcher according to claim 2, wherein said dynamic balancing mechanism further comprises an anchor stub disposed on opposite sides of said riser base below said horizontal line of extension of said compression spring, the ends of each said first flex cable being anchored on a respective anchor stub, each said first flex cable extending between the anchor stub and a respective outer pulley wheel at an angular orientation with respect to the horizontal line of extension, said second flex cable extending between said projectile stirrup carriage and said inner pulley wheels at an angular orientation different from the angular orientation of the first flex cables when said projectile stirrup carriage is in the cocked position, said first flex cable and said second flex cable exerting a vertical force component equal and opposite from the other and therefore balanced to prevent said compression spring from deviating from said horizontal line of extension when released from said cocked position.

5. The projectile launcher according to claim 1, wherein said pulley carriage comprises a carriage body having a wedge shape.

* * * * *